US010603927B2

(12) United States Patent
Okuda et al.

(10) Patent No.: US 10,603,927 B2
(45) Date of Patent: Mar. 31, 2020

(54) RECORDING METHOD HAVING DIFFERING AMOUNTS OF WHITE INK IN ADJACENT REGIONS OR HAVING A DIFFERENT NUMBER OF SCANS IN ADJACENT REGIONS

(71) Applicant: Seiko Epson Corporation, Tokyo (JP)

(72) Inventors: Ippei Okuda, Shiojiri (JP); Tsuyoshi Sano, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/117,399

(22) Filed: Aug. 30, 2018

(65) Prior Publication Data

US 2019/0061382 A1 Feb. 28, 2019

(30) Foreign Application Priority Data

Aug. 31, 2017 (JP) ..... 2017-166751

(51) Int. Cl.
*B41J 11/00* (2006.01)
*B41J 2/21* (2006.01)

(52) U.S. Cl.
CPC ..... *B41J 11/0015* (2013.01); *B41J 2/2107* (2013.01); *B41J 2/2117* (2013.01); *B41J 2/2132* (2013.01)

(58) Field of Classification Search
CPC .... B41J 11/0015; B41J 2/2117; B41J 2/2132; B41J 2/2107
See application file for complete search history.

(56) References Cited

U.S. PATENT DOCUMENTS

2015/0054883 A1* 2/2015 Okuda ..... C09D 11/40 347/20

FOREIGN PATENT DOCUMENTS

JP 2015-071738 A 4/2015

* cited by examiner

*Primary Examiner* — Bradley W Thies
(74) *Attorney, Agent, or Firm* — Harness, Dickey & Pierce, P.L.C.

(57) ABSTRACT

An ink jet recording method is provided for recording white and non-white ink compositions onto a moving recording medium. The recording medium includes a first region where both the white and non-white ink compositions are adhered, and a second region where only the white ink composition is adhered. Further, one or both of Conditions (i) and (ii) is satisfied. Condition (i): The amount of the white ink composition adhered in the first region is less than the amount of the white ink composition adhered in the second region. Condition (ii): The number of times the white ink composition is scanned across the first region is less than the number of times the white ink composition is scanned across in the second region.

10 Claims, 3 Drawing Sheets

RECORDING METHOD HAVING DIFFERING AMOUNTS OF WHITE INK IN ADJACENT REGIONS OR HAVING A DIFFERENT NUMBER OF SCANS IN ADJACENT REGIONS

BACKGROUND

1. Technical Field

The present invention relates to a recording method and a recording method.

2. Related Art

An ink jet recording method is a method of performing recording by discharging small droplets of an ink from fine nozzles and adhering the droplets to a recording medium. The method has features in that an image having high resolution and high quality can be recorded at a high speed in a relatively-cheap device. Regarding ink jet recording, so many consideration elements including, for example, properties of an ink to be used, stability in recording, and quality of an image to be obtained are provided. Thus, researches for not only an ink jet recording apparatus but also for an ink composition to be used or a recording method are actively performed.

For example, an examination of applying an ink jet recording method using an aqueous ink to a low-absorbent recording medium or a non-absorbent recording medium is performed. The aqueous ink is excellent from a point of safety or low pollution. As disclosed in, for example, JP-A-2015-071738, various examinations for printing a white image and a non-white image to overlap each other are performed.

As shown in the related art, it is considered that recording by overlapping a white ink and a non-white ink is useful in that it is possible to expect visibility or concealment of an image to be obtained and to form a more beautiful image. It is considered that an ink and a treatment solution (also referred to as a reaction solution) are used for further improve quality of an image.

In a case where recording using a treatment solution, that is, printing by overlapping a white ink and a non-white ink is performed, recording a more excellent image is required.

SUMMARY

An advantage of some aspects of the invention is to provide a recording method and a recording apparatus in which an image including a non-white region in which two-layer printing is performed by overlapping a white ink and a non-white ink and a white region formed by not using the non-white ink but using the white ink is recorded by using a treatment solution and in which an image in which both image quality in the white region and image quality in the non-white region are excellent can be recorded.

The invention can be realized in the following aspects or application examples.

According to an aspect of the invention, a recording method includes adhering of a treatment solution for coagulating a component of an ink composition to a recording medium, adhering a white ink composition including a white color material to the recording medium, and adhering a non-white ink composition including a non-white color material to the recording medium. The adhering of the white ink composition and the adhering of the non-white ink composition are performed by performing scanning in which a relative position between an ink jet head and the recording medium is changed while the ink composition is discharged from the ink jet head. A first region in which the white ink composition and the non-white ink composition are adhered and a second region in which the white ink composition is adhered, and the non-white ink composition is not adhered are formed on the recording medium. One or both of Condition (i) and Condition (ii) is satisfied. (i) The first region and the second region are formed such that an adhesion amount of the white ink composition has a relationship of the first region<the second region. (ii) The first region and the second region are formed such that the number of times of scanning in the adhering of the white ink composition has a relationship of the first region<the second region.

In this configuration, it is possible to easily record an image including the first region (region in which two-layer printing is performed by overlapping the white ink and the non-white ink) and the second region (region in which the non-white ink composition is not adhered), by using the treatment solution. Since one or both of Conditions (i) and (ii) is satisfied, it is possible to record an image in which both a shielding property in the second region (white region) and a coloring property in the first region (non-white region) are excellent and scratch resistance of the entirety of the image is highly maintained.

In the recording method, the adhesion amount of the white ink composition to the second region by one scanning in the adhering of the white ink composition may be equal to or smaller than 4 mg/inch$^2$.

In this configuration, since a situation in which the adhesion amount of the white ink in the second region per one scanning is too much does not occur, it is possible to sufficiently cause a reaction with the treatment solution and to further improve the shielding property in this region.

In the recording method, in the first region, among the white ink composition and the non-white ink composition, a time from when adhering of one composition to be previously adhered at a predetermined position is completed until the other composition to be adhered later at the predetermined position is adhered may be from 1 second to 60 seconds.

In this configuration, the later composition is adhered in a state where the composition which has been previously adhered is more properly dried. Thus, it is possible to easily diffuse the treatment solution in the composition to be adhered later and to sufficiently cause a reaction between the treatment solution and the composition. Accordingly, it is possible to further suppress an occurrence of blurring between the composition to be previously adhered and the composition to be adhered later.

In the recording method, the adhesion amount of the treatment solution in the first region may be from 5 mass % to 20 mass % of the total adhesion amount of the white ink composition and the non-white ink composition. The adhesion amount of the treatment solution in the second region may be from 5 mass % to 20 mass % of the adhesion amount of the white ink composition.

In this configuration, since the amount of the treatment solution is more proper in the region in which the ink composition is adhered, it is possible to record an image in which both the shielding property in the second region (white region) and the coloring property in the first region (non-white region) are more excellent and scratch resistance of the entirety of the image is highly maintained.

In the recording method, one or both the adhering of the white ink composition and the adhering of the non-white ink are performed on the recording medium heated by first heating in which the recording medium is heated. The surface temperature of the recording medium when the adhering of the white ink composition and the adhering of the non-white ink composition are performed may be from 30° C. to 45° C.

In this configuration, the reaction between the adhered ink and the treatment solution is accelerated more. Thus, it is possible to perform recording at a higher speed.

In the recording method, in the first region and the second region, the adhering of the treatment solution may be performed before the adhering of the white ink composition and the adhering of the non-white ink composition.

In this configuration, it is possible to more reliably perform the reaction between the treatment solution and each of the inks.

In the recording method, in the first region of a recording surface of the recording medium, either the white ink composition or the non-white ink composition may be adhered on a side close to the recording medium.

In this configuration, it is possible to handle both a case where an image recorded on a recorded matter is displayed on the recording surface side of a recording medium and a case of being displayed on an opposite side of the recording surface.

In the recording method, recording may be performed on a low-absorbent recording medium or a non-absorbent recording medium.

In the recording method, the adhering of the white ink composition and the adhering of the non-white ink composition may be performed by an ink jet method.

In this configuration, it is possible to form a high-definition image.

In the recording method, recording may be performed by first scanning in which the white ink composition is adhered to the second region and the first region and second scanning in which the white ink composition is adhered to the second region and the white ink composition is not adhered to the first region. The first scanning and the second scanning may satisfy Condition (ii).

In this configuration, it is possible to form an image with the smaller number of times of scanning.

In the recording method, the treatment solution may contain any one selected from a polyvalent metal salt, a cationic resin, and an organic acid, as a coagulant.

In this configuration, regarding white and non-white images, it is possible to form an image having a favorable coloring property.

According to another aspect of the invention, a recording apparatus performs recording by the above-described recording method.

In this configuration, it is possible to easily record an image including the first region (region in which two-layer printing is performed by overlapping the white ink and the non-white ink) and the second region (region in which the non-white ink composition is not adhered), by using the treatment solution. Since one or both of Conditions (i) and (ii) is satisfied, it is possible to record an image in which both a shielding property in the second region (white region) and a coloring property in the first region (non-white region) are excellent and scratch resistance of the entirety of the image is highly maintained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described. The embodiment which will be described later is an example of the invention. The invention is not limited to the following embodiment and includes various modifications made in a range without changing the gist of the invention. It is not necessary that all components which will be described below are the essential components of the invention.

A recording method according to the embodiment includes a treatment-solution adhering step, a white-ink adhering step, and a non-white-ink adhering step. An image formed by the recording method in the embodiment, an ink jet method, and a recording medium will be described below. Then, each step and the like will be described.

1. Image Formed by Recording Method

Figure 1:
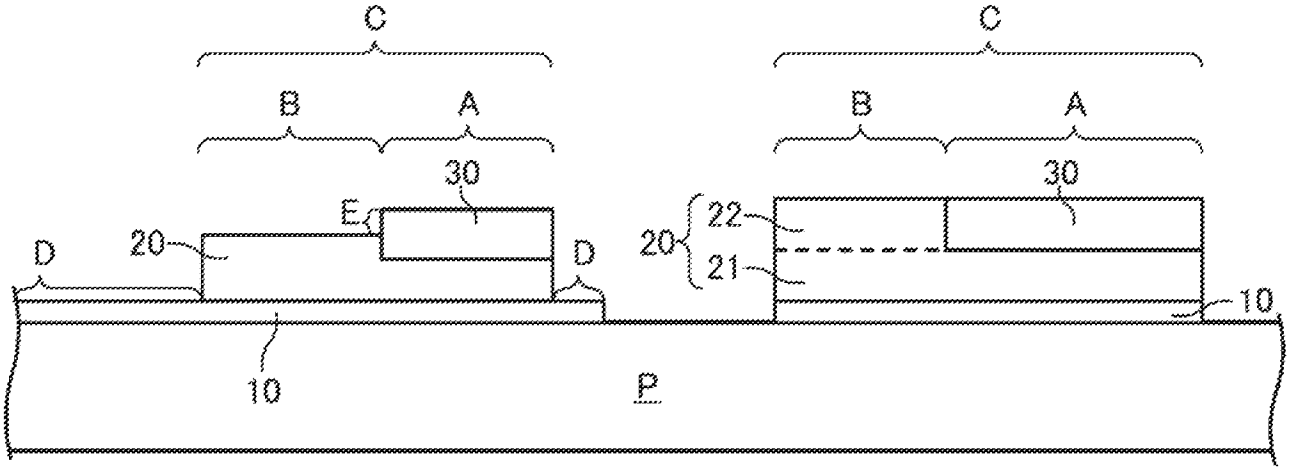
FIG. 1 is a schematic diagram illustrating an image formed by a recording method according to an embodiment.

FIG. 1 is a schematic diagram illustrating an image formed by the recording method in the embodiment. As illustrated in FIG. 1, in the recording method in the embodiment, an image region C is formed on a recording medium P. The image region C includes a first region A in which a white ink composition and a non-white ink composition are adhered and a second region B in which the white ink composition is adhered, and the non-white ink composition is not adhered. Thus, the image region C includes a non-white first region A and a white second region B.

The first region A is formed in a manner that a white ink layer 20 obtained by adhering the white ink composition and a non-white ink layer 30 obtained by adhering the non-white ink composition are stacked. In the second region B, a layer which includes the white ink layer 20 obtained by adhering the white ink composition and does not include the non-white ink layer is formed. For the convenient descriptions, the second region B in the image region C on the right side of FIG. 1 is illustrated to distinguish a white ink layer 21 as a first layer and a white ink layer 22 as a second layer by a broken line. The white ink layer 21 and the white ink layer 22 may be considered as one layer.

In the recording method in the embodiment, a treatment solution is adhered to the recording medium P in the treatment-solution adhering step. In the example illustrated in FIG. 1, a treatment solution layer 10 in which the treatment solution is adhered in the treatment-solution adhering step is illustrated. The treatment solution layer 10 in FIG. 1 is illustrated in a form of "a layer" for the convenient descriptions. However, the shape of the layer may not be made by evaporation of components of the treatment solution or diffusion of the components thereof into the ink layer. Thus, the treatment solution layer 10 corresponds to a region formed by adhering the treatment solution and does not necessarily remain as the layer. As illustrated in FIG. 1, the treatment solution layer 10 may be formed at a portion of the recording medium P other than the image region C as illustrated in the example on the left side in FIG. 1 or may be formed only in the image region C as illustrated in the example on the right side in FIG. 1.

In FIG. 1, the height (thickness) of each layer conceptually indicates the adhesion amount of the adhered ink composition. In the recording method in the embodiment, as illustrated in FIG. 1, the height of the first region A may be equal to or different from the height of the second region B. In the example on the left side in FIG. 1, the first region A is illustrated to have a height which is higher than that of the second region B (see E in FIG. 1). However, the height of the first region A may be lower than that of the second region B. That is, the total adhesion amount of the white ink composition and the non-white ink composition to the first region A may be equal to or different from the total adhesion amount of the white ink composition to the second region B.

In any case, the image region C is formed such that the total adhesion amount of the white ink composition in the first region A is smaller than the total adhesion amount of the white ink composition in the second region B. That is, the adhesion amount of the white ink composition has a relationship of the first region A< the second region B (this state may be referred to as "Condition (i)" below).

In Condition (i), a difference between the total adhesion amount of the white ink composition in the first region A and the total adhesion amount of the white ink composition in the second region B is greater than 0 mg/inch$^2$, preferably from 1 mg/inch$^2$ to 18 mg/inch$^2$, more preferably from 2 mg/inch$^2$ to 15 mg/inch$^2$, and further preferably from 5 mg/inch$^2$ to 10 mg/inch$^2$.

In a case of satisfying Condition (i), the adhesion amount of the white ink composition in the first region A is small, and thus the treatment solution in the first region A easily remains. Thus, it is possible to sufficiently cause a reaction of the non-white ink composition adhering to the first region A with the treatment solution, and to improve quality of a non-white image. Even though the adhesion amount of the white ink composition in the first region A is small, the non-white ink composition and the white ink composition are adhered to the first region A. Thus, a situation in which concealment of the first region A is deteriorated does not occur.

The total adhesion amount of the first region A and the total adhesion amount of the second region B may be determined, for example, in consideration of balance between the concealment of the white ink composition and the coloring property of the non-white ink composition. For example, in a case where the coloring property of the non-white ink composition is desired to have a priority over the concealment of the white ink composition, a design may be appropriately made, for example, the total adhesion amount of the first region A is set to be greater than the total adhesion amount of the second region B, as in the example on the left side of FIG. 1.

An expression of "the total adhesion amount" in this specification is used to mean the total adhesion amount of the white ink composition and the non-white ink composition in the first region A. In addition, since a case where the white ink layer 20 or the non-white ink layer is formed by performing the adhering step plural times may be provided, the expression of "the total adhesion amount" is used to mean the total adhesion amount in this case.

In a case where the white ink layer 20 as illustrated on the left side of FIG. 1 is formed by one white-ink adhering step, the white ink layer 20 can be formed to have a structure in FIG. 1 by setting the adhesion amount to the first region A to be smaller than the adhesion amount to the second region B (adjusting the discharge amount for each region). Then, the non-white ink layer 30 is formed.

In a case where the white ink layer 20 as illustrated on the left side of FIG. 1 is formed by performing the white-ink adhering step plural times, the white ink layer 20 can be formed to have a structure in FIG. 1 by setting the total adhesion amount to the first region A to be smaller than the total adhesion amount to the second region B. In this case, the white-ink adhering step can be performed plural times such that the height of the white ink layer 20 finally reaches the height (thickness) in FIG. 1. The height can be randomly adjusted depending on the number of times of performing the white-ink adhering step or the discharge amount of the white ink composition in each of the white-ink adhering steps. In a case where the discharge amount is set to be constant, the height can be adjusted depending on the number of times of performing the white-ink adhering step (number of times of scanning).

In a case where a structure as illustrated on the right side of FIG. 1 is formed, firstly, the white ink layer 21 as the first layer is formed by the white-ink adhering step, and then, the white ink layer 22 as the second layer of the second region B and the non-white ink layer 30 of the first region A are simultaneously or individually formed. Thereby, the white ink layer 20 and the non-white ink layer 30 can be formed to have the structures in FIG. 1.

Even in a case where the white ink layer 20 as illustrated on the right side of FIG. 1 is formed, the white ink layer 20 can be formed by performing the white-ink adhering step plural times. That is, the structure as illustrated on the right side of FIG. 1 can be formed in a manner that the white-ink adhering step is performed plural times so as to form the white ink layer 21 as the first layer, and then the white-ink adhering step is performed plural times or the non-white-ink adhering step is performed plural times.

As described above, regardless of performing the white-ink adhering step once or plural times, the image region C having the structure as illustrated in FIG. 1 can be formed. However, it is preferable that the adhesion amount of the ink composition to be adhered in one step be set to be as many as the component of the treatment solution can be diffused from the treatment solution layer 10. From this viewpoint, the adhesion amount of the ink composition to be adhered in one step is, for example, equal to or smaller than 5 mg/inch$^2$, preferably equal to or smaller than 4 mg/inch$^2$, more preferably equal to or smaller than 3.5 mg/inch$^2$, further preferably equal to or smaller than 3 mg/inch$^2$, particularly preferably equal to or smaller than 2.5 mg/inch$^2$, and further particularly preferably equal to or smaller than 2 mg/inch$^2$. From a viewpoint of the concealment or the coloring property, the adhesion amount thereof is equal to or greater than 0.05 mg/inch$^2$, and preferably equal to or greater than 0.1 mg/inch$^2$, in order to sufficiently cause the reaction.

with this configuration, a situation in which the adhesion amount of the white ink composition in the second region B per one scanning is too much does not occur. Thus, it is possible to sufficiently cause a reaction with the treatment solution and to further improve the shielding property of second region B.

In a case where the structure as illustrated in FIG. 1 is formed, for example, in a case where the adhesion amount is set to exceed the above range if the white ink layer 20 is formed by performing the white-ink adhering step once, it is preferable that the adhesion amount be reduced to be within the above range, and the number of times of performing the white-ink adhering step increase. Thus, it is possible to easily set the adhesion amount per one time to be within the above range. In a case where the adhesion amount per one time exceeds the above range even in a case of performing the white-ink adhering step plural times, the adhesion amount can be reduced to be within the above range, and the number of times of performing the white-ink adhering step can increase such that the adhesion amount is within the above range. The above descriptions are similarly applied to the non-white-ink adhering step.

"The region" in the specification means a portion occupying a predetermined area on the recording medium such that each of the adhesion amount of the white ink composition adhered to the region and the adhesion amount of the non-white ink composition adhered to the region is substantially uniform. One region indicates a region capable of being visually recognized to have the same color, and has an area of 1 $mm^2$ or smaller, for example. Regarding an expression of the adhesion amount being substantially uniform, for example, in a case where the duty is low, the adhesion amount of the ink composition at a position at which a dot of the ink composition is landed is strictly different from the adhesion amount of the ink composition at a position at which a dot of the ink composition is not landed. However, the region means a macroscopic (macro) range having an area which is larger than the area of one dot. Macroscopically, it is assumed that the ink adhesion amount is uniform in the area, and an unevenness of the adhesion amount depending on whether or not dots are adhered is ignored.

In a case where the duty is low, even in a region (first region A) in which both the white ink composition and the non-white ink composition are adhered, a portion in which white does and non-white dots do not overlap each other is also provided microscopically (for example, a scale of droplets (landed dots) in the ink jet method). However, it is assumed that the region corresponds to the ink compositions stacked when macroscopically viewed, and providing a portion in which dots do not overlap each other when viewed in a dot unit is ignored. Thus, it is assumed that the first region A here is considered as a region in which the white ink composition and the non-white ink composition are stacked, as the entirety of the region.

In the specification, it is assumed that "the ink composition" indicates "one or both of the white ink composition and the non-white ink composition". Details of the white ink composition and the non-white ink composition will be described later.

2. Ink Jet Method

The white-ink adhering step and the non-white-ink adhering step are performed by performing scanning in which the relative position between the recording medium P and an ink jet head is changed while the ink composition is discharged from the ink jet head. The scanning in which the relative position between the recording medium P and the ink jet head is changed may be performed plural times in order to adhere the white ink composition and the non-white ink composition to the second region B of the image region C.

If an ink jet recording apparatus is used, it is possible to easily perform scanning in which the relative position between a recording medium and an ink jet head is changed while the ink composition is discharged from the ink jet head. The ink jet recording apparatus is not particularly limited so long as the ink jet recording apparatus includes at least an ink storage container (cartridge, tank, and the like) that stores an ink composition and an ink jet head connected to the ink storage container and has a mechanism in which an image can be formed on a recording medium P by discharging the ink composition from the ink jet head.

As the ink jet recording apparatus in the embodiment, either a serial type or a line type can be used. The ink jet head is mounted in the ink jet recording apparatus of such a type. While a relative position relationship between a recording medium P and the ink jet head is changed, droplets of the ink composition are discharged from nozzle holes of the ink jet head at predetermined timings (intermittently) with a predetermined volume (mass), so as to adhere the ink composition to the recording medium P. Thereby, a predetermined image can be formed.

Here, generally, in a serial type ink jet recording apparatus, a transporting direction of a recording medium P intersects a direction of a reciprocating operation of an ink jet head. The relative position relationship between the recording medium P and the ink jet head is changed by a combination of the reciprocating operation of the ink jet head and a transporting operation (also including the reciprocating operation) of the recording medium P. In this case, generally, a plurality of nozzle holes (holes for discharging an ink composition) is disposed in the ink jet head, and a row of nozzle holes (nozzle row) is formed along the transporting direction of the recording medium P. A plurality of nozzle rows is formed in the ink jet head in accordance with the type of the ink composition or the number of ink compositions.

Generally, in a line type ink jet recording apparatus, an ink jet head changes the relative position relationship between a recording medium P and the ink jet head by transporting the recording medium P (including the reciprocating operation), without the reciprocating operation. Even in a case, generally, a plurality of nozzle holes is disposed in the ink jet head, and a row of nozzle holes (nozzle row) is formed along a direction intersecting the transporting direction of the recording medium P.

In a case of satisfying Condition (i), the line type ink jet recording apparatus can be more suitably employed as the ink jet type. This case is preferable from a point of a high recording speed and the like.

The ink jet method is not particularly limited so long as droplets of an ink composition can be adhered to a recording medium P by being discharged from fine nozzle holes. For example, as a droplet discharge method (ink jet method), a piezo method, a method of discharging an ink by using bubbles which are generated by heating the ink, and the like can be used. However, the piezo method is preferable from a viewpoint of difficulty in thermal alteration of an ink composition, and the like.

For the ink jet recording apparatus, for example, well-known configurations such as a heating unit, a drying unit, a roll unit, and a winding device can be employed without limitations.

In a case using the ink jet recording apparatus, the type of an ink composition discharged from nozzles can be appropriately selected. For example, if nozzles for discharging the white ink composition and nozzles for discharging the non-white ink composition are provided, the ink compositions of predetermined amounts can be discharged from the nozzles at predetermined timings of predetermined intervals. Thus, for example, it is possible to easily form the white ink layer 20 and the non-white ink layer 30 of the above-described image region C by scanning in which the relative position between a recording medium P and an ink jet head is changed while the ink composition is discharged from the ink jet head (in this specification, may be simply referred to as "scanning").

Thus, if the ink jet recording apparatus is used, in a case where the image region C is formed on the recording medium P, the image region C can be formed such that the number of times of scanning in which the white ink composition is adhered in the first region A is smaller than the number of times of scanning in which the white ink composition is adhered in the second region B. That is, the image region C can be formed such that the number of times of scanning in the white-ink adhering step satisfies a relationship of the first region A< the second region B (this relationship may be referred to as "Condition (ii)" below). The scanning means the main scanning.

With this configuration, the number of times of scanning in the white-ink adhering step in the second region B can be greater than the number of times of scanning in the white-ink adhering step in the first region A. Therefore, for example, in a case considering the upper limit and the like of the discharge amount, even in a case the adhesion amount of the white ink composition in the second region B is equal to or, if necessary, greater than the adhesion amount of the white ink composition in the first region A, in the second region B, it is possible to reduce the adhesion amount of each scanning by increasing the number of times of scanning in the white-ink adhering step. In addition, a time when an ink reacts with the treatment solution can be provided for each scanning, and thus it is possible to more improve image quality. In the first region A, since the white ink composition (white ink layer 20) is concealed by the non-white ink composition (non-white ink layer 30), the deterioration of image quality for the white color is less conspicuous. Thus, even though the number of times of scanning is set to be reduced, an influence on image quality is small.

Here, the number of times of scanning in the adhering step refers to the number of times of scanning in which an ink is adhered to a predetermined region of an image. For example, in a case where an image is recorded at a recording resolution which is 720×1440 dpi in a scanning direction and a sub-scanning direction, by using a head in which nozzle density of a nozzle row is 360 dpi, adhering is set to be performed at an ink droplet resolution of 360 dpi in the scanning direction and the sub-scanning direction, in one scanning. Here, it is assumed that an ink droplet is adhered to one pixel once. The pixel means a unit of a place to which an ink droplet is to be adhered, and which is defined by the recording resolution.

In this case, an expression of the number of times of scanning=((the recording resolution in the scanning direction)/(the ink droplet resolution in the scanning direction in one scanning))×((the recording resolution in the sub-scanning direction)/(the ink droplet resolution in the sub-scanning direction in one scanning))=2×4=8 times is established, and this means that an ink is adhered by performing scanning 8 times.

The ink droplet resolution in the sub-scanning direction in one scanning has a restriction for the nozzle density of a nozzle row. The ink droplet resolution in the main scanning direction in one scanning is determined in accordance with a period of a discharge in which ink droplets are discharged from nozzles, and a speed (scanning speed, for example, carriage speed) at which the positions of the nozzles and the position of a recording medium are relatively changed in the scanning direction when scanning is performed. Thus, the number of times of scanning changes depending on the recording resolution of an image to be recorded, the nozzle density of a head to be used, a discharge frequency, or the scanning speed. The number of times of scanning also changes depending on the number of times of adhering ink droplets to one pixel. As the number of times of the adhering increases, the number of times of scanning increases.

The above-described calculation formula for obtaining the number of times of scanning is just one example. Regarding comparison for determination of whether or not the number of times of scanning is large or small, it is not limited to the above formula. Comparison can also be performed with the number of times of scanning, which is required for performing recording of an image (for example, square image of 1 inch×1 inch in length and breadth) having a predetermined area.

In Condition (ii), a difference between the number of times of scanning in the white-ink adhering step in the first region A and the number of times of scanning in the white-ink adhering step in the second region B is preferably from 1 to 20, more preferably from 2 to 15, and further preferably from 3 to 10.

In a case of satisfying Condition (ii), recording which includes first scanning and second scanning may be performed. In the first scanning, the white ink composition is adhered to the second region B and the first region A. In the second scanning, the white ink composition is adhered to the second region B, but the white ink composition is not adhered to the first region A. With this configuration, an image can be formed at the smaller number of times of scanning. Further, the non-white ink composition may be adhered to the first region A in the second scanning. In this manner, an image can be formed at the much smaller number of times of scanning.

Figure 3:
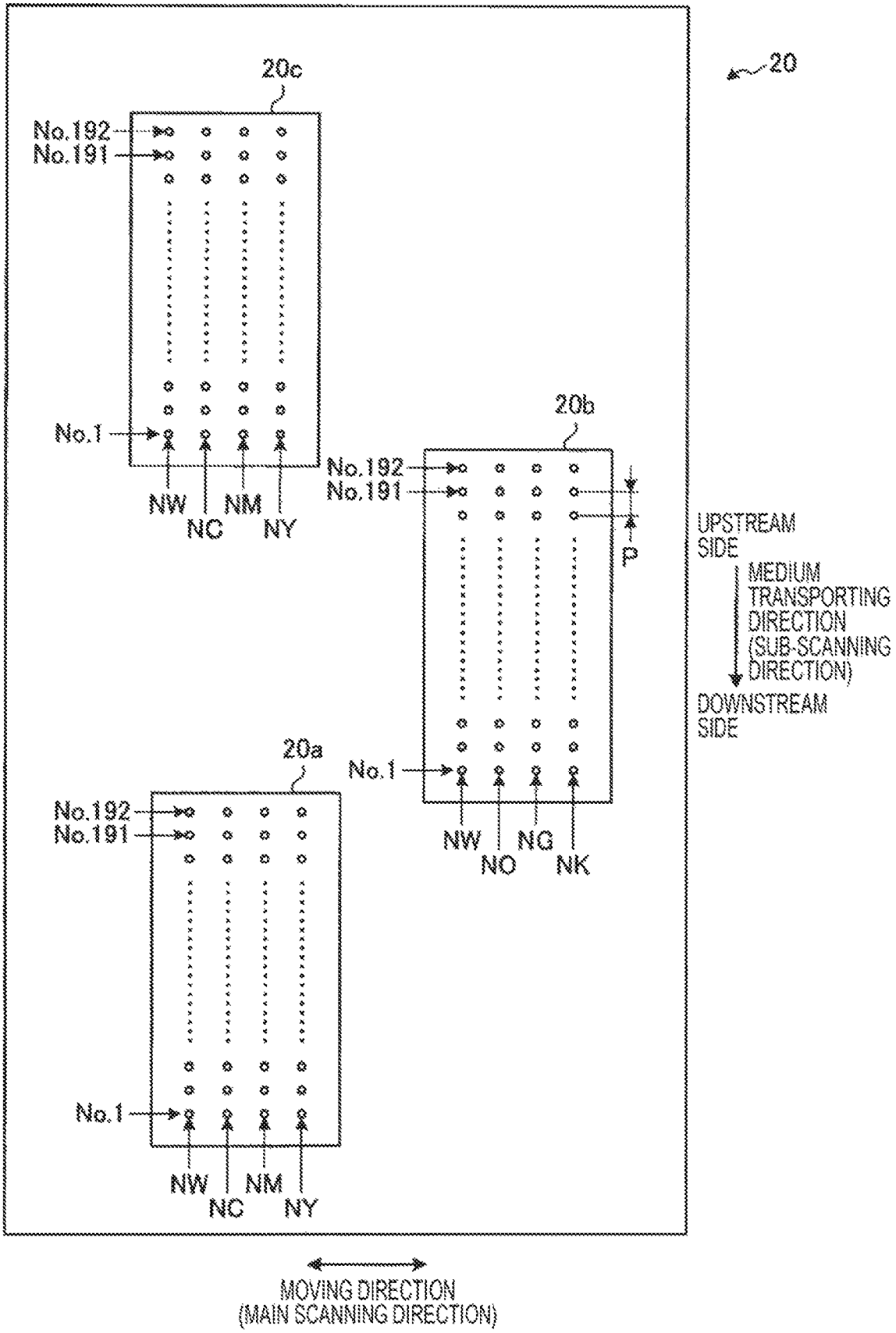
FIG. 3 is a schematic diagram illustrating an example of arrangement of heads in a serial printer.

FIG. 3 illustrates an example of a head arrangement of a serial printer. Three heads (heads 20*a*, 20*b*, and 20*c*) as in FIG. 3 are mounted in a carriage. Each of the heads includes a plurality of nozzle rows (NW, NC, NM, and NY). Each of the nozzle rows includes a plurality of nozzles No. 1 to 192 at an inter-nozzle distance P in the sub-scanning direction. The number of nozzles is not limited.

For example, the nozzle row NK in each of the heads is filled with the treatment solution, the nozzle row NW in each of the heads is filled with a white ink, and the nozzle row NC in each of the heads is filled with a non-white ink.

In a case where recording is performed while scanning and sub-scanning (transporting of recording medium) are alternately repeated, firstly, the treatment solution may be discharged from the head 20*c*. As the recording proceeds, the first scanning in which the white ink is adhered to the first region A and the second region B by discharging the white ink from the head 20*b* may be performed. Further, the second scanning in which the non-white ink is adhered to the first region A by discharging the non-white ink from the head 20*a* while the white ink is adhered to the second region B by discharging the white ink from the head 20*a* may be performed.

This case is preferable from a point of a high recording speed. As described above, a case where the nozzle row for discharging the white ink and the nozzle row for discharging the non-white ink are arranged in the scanning direction is preferable from a point of performing the above-described second scanning.

The recording method is not limited to the above example, as follows. The treatment solution may be discharged from the nozzle row of the head 20*b* or the head 20*a*. The recording medium may be reversely fed and transported again, and then the non-white ink may be discharged. The non-white ink may be discharged so as to be adhered before the white ink. Only the nozzle row of the head required for recording may be filled with the required ink or the treatment solution.

3. Recording Medium

The shape of a recording medium P used in the recording method in the embodiment may be a sheet-like shape, a plate-like shape, a cloth-like shape, a three-dimensional shape, and the like.

The recording medium P may be an absorbent recording medium that absorbs an ink droplet or may be a non-absorbent recording medium or a low-absorbent recording medium that does not absorb an ink droplet or includes a low-absorbent printing surface.

Examples of the absorbent recording medium include paper such as plain paper or paper exclusive for an ink jet, a sheet having an ink receiving layer, and cloth. Examples of the non-absorbent recording medium include a non-absorbent recording medium such as metal, glass, a plastic film which is not subjected to a surface treatment for ink jet printing (that is, in which an ink absorbable layer is not formed), a medium in which a base material such as paper is coated with plastic, or a medium to which a plastic film is bonded. As the plastic referred here, polyvinyl chloride, polyethylene terephthalate, polycarbonate, polystyrene, polyurethane, polyethylene, polypropylene, and the like are exemplified.

Examples of the low-absorbent recording medium include printing paper such as art paper, coated paper, and matte paper. Here, "the non-absorbent or low-absorbent recording medium" in this specification indicates "a recording medium in which a water absorption amount from a contact start to 30 $msec^{1/2}$ in the Bristow method is equal to or smaller than 10 $mL/m^2$. The Bristow method is the most popular method as a method of measuring the amount of absorbed liquid in a short time and is employed by Japan Paper and Pulp Technology Association (JAPAN TAPPI). Details of the test method are described in the standard No. 51 "Paper and paperboard-liquid absorbency test method—Bristow method" of "JAPAN TAPPI Paper pulp test method, 2000 edition".

The recording medium P may be colorless transparent, translucent, colored transparent, chromatic opaque, achromatic opaque, or the like. The recording medium P may be any of a gross type, a mat type, and a dull type. As the commercial recording medium P, a glossy vinyl chloride sheet (for example, product name of SP-SG-1270C, manufactured by Roland DG Corporation), a PET film (for example, product name of XEROX FILM <without frame>, manufactured by Fuji Xerox Co., Ltd.), and the like are provided.

In the recording method in the embodiment, such a low-absorbent recording medium or a non-absorbent recording medium can be used as the recording medium P. Even though the low-absorbent recording medium or the non-absorbent recording medium is used in the recording method in the embodiment, it is possible to realize the sufficient concealment and coloring property of an image.

4. Condition in Recording Method

As described above, in the recording method in the embodiment, the white-ink adhering step and the non-white-ink adhering step are performed by performing scanning in which the relative position between a recording medium P and an ink jet head is changed while the ink composition is discharged from the ink jet head. The first region A in which the white ink composition and the non-white ink composition are adhered and the second region B in which the white ink composition is adhered, and the non-white ink composition is not adhered are formed on the recording medium P.

In the recording method in the embodiment, one or both of Condition (i) and Condition (ii) is satisfied. (i) The adhesion amount of the white ink composition has a relationship of the first region A< the second region B. (ii) The number of times of scanning in the white-ink adhering step has a relationship of the first region A< the second region B.

5. Each Step of Recording Method

The recording method according to the embodiment includes the treatment-solution adhering step, the white-ink adhering step, and the non-white-ink adhering step.

5.1. Treatment-Solution Adhering Step

The recording method in the embodiment includes the treatment-solution adhering step. The treatment-solution adhering step is a step of adhering a treatment solution for coagulating a component of an ink composition (which will be described later) to a recording medium P. The treatment solution and the treatment-solution adhering step will be described below.

5.1.1. Treatment Solution

The treatment solution (may also be referred to as a reaction solution or a pretreatment solution) has a function of coagulating (or thickening) a component of an ink composition. The treatment solution contains a coagulant for mainly coagulating a color material or a resin by reacting with the component of the ink composition. In the embodiment, the treatment solution has the content of a color material, which is equal to or smaller than 0.2 mass %. The treatment solution is a liquid used by being adhered to a recording medium P before, after, or simultaneous with adhering of the ink composition, in addition to a liquid (ink composition) used for coloring the recording medium.

Since the treatment solution used in the embodiment includes the coagulant, the coagulant reacts with a component (for example, component such as a resin or a color material) included in an ink composition in a case where the treatment solution is brought into contact with the ink composition (which will be described later). Thus, a dispersion state of the color material or the resin in the ink composition changes, and thus the color material or the resin can be coagulated. With such an action, for example, it is possible to improve the coloring property of a color material on a recording medium. In addition, it is possible to form an image in which the coloring property is favorable in a non-white image portion, and the concealment is sufficient in white and non-white image portions.

In a case where the treatment solution is adhered and then the ink composition is adhered, the coagulant included in the treatment solution is diffused in the ink composition, and thus a portion or the entirety of the coagulant is consumed by the reaction. Further, in a case where the coagulant diffused in the ink composition remains in the ink composition and then an ink composition is adhered, the coagulant can be diffused in the ink composition which has been adhered later. In this case, as described above, if the adhesion amount (for one time) of the ink composition to be adhered later is too much, diffusion may occur insufficiently. Thus, it is considered that a more preferable range is provided for the adhesion amount of the ink composition when the ink composition to be adhered later is adhered in one scanning.

Coagulant

Examples of the coagulant contained in the treatment solution include a polyvalent metal salt, a cationic compound (cationic resin, cationic surfactant, and the like), and an organic acid. The coagulant may be singly used or may be used in combination of two kinds or more. Among the coagulants, from a point of excellent reactivity with the component included in the ink composition, one or more coagulants selected from the group consisting of a polyvalent metal salt, a cationic resin, and an organic acid is preferably used.

As the polyvalent metal salt, a water-soluble compound configured from a polyvalent metal ion having two or more valences and an anion bonded to the polyvalent metal ion is provided. Specific examples of the polyvalent metal ion include divalent metal ions such as $Ca^{2+}$, $Cu^{2+}$, $Ni^{2+}$, $Mg^{2+}$, $Zn^{20+}$, and $Ba^{2+}$; and trivalent metal ions such as $Al^{3+}$, $Fe^{3+}$, and $Cr^{3+}$. Examples of the anion as the counter ion include $Cl^-$, $I^-$, $Br^-$, $SO_4^{2-}$, $ClO^{3-}$, $NO^{3-}$, $HCOO^-$, and $CH_3COO^-$. Among the polyvalent metal salts, from a viewpoint of stability of the treatment solution or reactivity as the coagulant, a calcium salt and a magnesium salt are preferable.

Examples of the cationic resin include a cationic urethane resin, a cationic olefin resin, a cationic polyamine resin, a cationic polyamide resin, a cationic polyacrylamide resin, and a cationic polyallylamine resin.

As the cationic urethane resin, well-known resins can be appropriately selected and used. As the cationic urethane resin, a commercial product can be used. For example, HYDRAN CP-7010, CP-7020, CP-7030, CP-7040, CP-7050, CP-7060, and CP-7610 (above product names, manufactured by DIC CORPORATION), SUPERFLEX 600, 610, 620, 630, 640, and 650 (above product names, manufactured by DKS Co. Ltd.), urethane emulsions WBR-2120C and WBR-2122C (above product name, manufactured by TAISEI FINE CHEMICAL CO., LTD.) can be used.

The cationic olefin resin has olefin such as ethylene, propylene or the like, in a structural skeleton. Well-known resins can be appropriately selected and used as the cationic olefin resin. The cationic olefin resin may be in an emulsion state in which the cationic olefin resin is dispersed in a solvent including water, an organic solvent, or the like. As the cationic olefin resin, a commercial product can be used. For example, ARROW BASE CB-1200 and CD-1200 (above product names, manufactured by UNITIKA LTD.) are exemplified.

As the cationic polyallylamine resin, well-known resins can be appropriately selected and used. Examples of the cationic polyallylamine resin can include polyallylamine hydrochloride, polyallylamine amide sulfate, allylamine hydrochloride-diallylamine hydrochloride copolymer, allylamine acetate-diallylamine acetate copolymer, allylamine acetate-diallylamine acetate copolymer, allylamine hydrochloride-dimethylallylamine hydrochloride copolymer, allylamine-dimethylallylamine copolymer, polydiallylamine hydrochloride, polymethyldiallylamine hydrochloride, polymethyldiallylamine amide sulfate, polymethyldiallylamine acetate, polydiallyldimethylammonium chloride, diallylamine acetate-sulfur dioxide copolymer, diallyl methylethylammonium ethyl sulfate-sulfur dioxide copolymer, methyldiallylamine hydrochloride-sulfur dioxide copolymer, diallyldimethylammonium chloride-sulfur dioxide copolymer, and diallyldimethylammonium chloride-acrylamide copolymer.

As the cationic polyamine resin, well-known resins can be appropriately selected and used. Any resin may be provided so long as the resin has a polyamine structure. It is assumed that the polyamine resin includes a resin having a polyamide structure, a polyacrylamide structure, or a polyallyl structure together with a polyamine structure. As other cationic resins, well-known resins can be appropriately selected and used.

As the commercial product of the cationic polyallylamine resin, for example, PAA-HCL-01, PAA-HCL-03, PAA-HCL-05, PAA-HCL-3L, PAA-HCL-10L, PAA-H-HCL, PAA-SA, PAA-01, PAA-03, PAA-05, PAA-08, PAA-15, PAA-15C, PAA-25, PAA-H-10C, PAA-D11-HCL, PAA-D41-HCL, PAA-D19-HCL, PAS-21CL, PAS-M-1L, PAS-M-1, PAS-22SA, PAS-M-1A, PAS-H-1L, PAS-H-5L, PAS-H-10L, PAS-92, PAS-92A, PAS-J-81L, and PAS-J-81 (product names, manufactured by NITTOBO MEDICAL CO., LTD.), and Himo Neo-600, Himoloc Q-101, Q-311, and Q-501, and Himax SC-505 and SC-505 (product names, manufactured by HYMO CORPORATION.) can be used.

Preferred examples of the organic acid include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyrone carboxylic acid, pyrrole carboxylic acid, furan carboxylic acid, pyridine carboxylic acid, coumaric acid, thiophene carboxylic acid, nicotinic acid, derivatives thereof, or salts thereof. The organic acid may be singly used or may be in combination of two kinds or more.

The cationic surfactant may be used as the coagulant. Examples of the cationic surfactant include primary, secondary and tertiary amine salt type compounds, alkylamine salts, dialkylamine salts, aliphatic amine salts, benzalkonium salts, quaternary ammonium salts, quaternary alkylammonium salts, alkylpyridinium salts, sulfonium salts, phosphonium salts, onium salts, and imidazolinium salts. Specific examples of the cationic surfactant include hydrochloride, acetate, and the like such as lauryl amine, Yashi amine, and Rosin amine, lauryl trimethyl ammonium chloride, cetyl trimethyl ammonium chloride, benzyl tributyl ammonium chloride, benzalkonium chloride, dimethyl ethyl lauryl ammonium ethyl sulfate, dimethyl ethyl octyl ammonium ethyl sulfate, trimethyl lauryl ammonium hydrochloride, cetyl pyridinium chloride, cetyl pyridinium bromide, dihydroxy ethyl lauryl amine, decyl dimethyl benzyl ammonium chloride, dodecyl dimethyl benzyl ammonium chloride, tetradecyl dimethyl ammonium chloride, hexadecyl dimethyl ammonium chloride, and octadecyl dimethyl ammonium chloride.

The coagulant may be singly used or may be used in combination of plural kinds. The content of the coagulant in the treatment solution is from 0.1 mass % to 25 mass % in total, with respect to the total mass (100 mass %) of the treatment solution. The content of the coagulant in the treatment solution may be from 1 mass % to 20 mass % or may be from 3 mass % to 10 mass %. The lower limit of the content of the coagulant is preferably equal to or greater than 2 mass %, more preferably equal to or greater than 3 mass %, and further preferably equal to or greater than 5 mass %. The upper limit of the content of the coagulant is preferably equal to or smaller than 15 mass %, and more preferably equal to or smaller than 10 mass %.

The treatment solution may contain components as follows, in addition to the coagulant.

Water

The treatment solution used in the embodiment may be an aqueous type using water as a main solvent. The water is a component which is evaporated and scattered by drying after the treatment solution is adhered to a recording medium. As the water, water such as pure water (for example, ion exchanged water, ultrafiltered water, reverse osmosis water, and distilled water) or ultrapure water, in which ionic impurities have been removed as much as possible, is preferable. If water sterilized by, for example, irradiation with an ultraviolet ray or addition of hydrogen peroxide is used, it is possible to suppress an occurrence of mold and bacteria in a case where the treatment solution is preserved for a long term. Thus, using such water is suitable. The content of the water included in the treatment solution may be set to be, for example, equal to or greater than 40 mass % with respect to the total mass (100 mass %) of the treatment solution. The content of the water included in the treatment solution is preferably equal to or greater than 20 mass %, more preferably equal to or greater than 30 mass %, and further preferably equal to or greater than 40 mass %.

Solvent

The treatment solution used in the embodiment may contain an organic solvent. It is possible to improve wettability of the treatment solution into a recording medium by containing the organic solvent. As the organic solvent, a water-soluble organic solvent is preferable.

The organic solvent is not particularly limited. Examples of the organic solvent include 1,2-alkanediols, polyhydric alcohols, pyrrolidone derivatives, lactones, and glycol ethers.

Examples of 1,2-alkanediols include 1,2-propanediol, 1,2-butanediol, 1,2-pentanediol, 1,2-hexanediol, and 1,2-octanediol. 1,2-alkanediols are excellent in performing an action of improving wettability into a recording medium so as to cause the recording medium to be wet uniformly. Thus, it may be possible to form an image having excellent adhesiveness onto the recording medium.

Examples of polyhydric alcohols include ethylene glycol, diethylene glycol, propylene glycol, dipropylene glycol, 1,3-propanediol, 1,4-butanediol, 1,6-hexanediol, trimethylolpropane, and glycerin. Polyhydric alcohols can be preferably used because it is possible to reduce an occurrence of clogging, discharge poorness, or the like by suppressing drying and solidification on the nozzle formation surface of an ink jet head of an ink jet recording apparatus.

Examples of the pyrrolidone derivatives include N-methyl-2-pyrrolidone, N-ethyl-2-pyrrolidone, N-vinyl-2-pyrrolidone, 2-pyrrolidone, N-butyl-2-pyrrolidone, and 5-methyl-2-pyrrolidone. The pyrrolidone derivatives can also act as a favorable solubilizer of a resin component.

"Lactone" is a generic term of cyclic components having an ester group (—CO—O—) in the ring. The lactone is not particularly limited so long as the substance is included in the above definition. Lactone having 2 to 9 carbon atoms is preferable. Specific examples of such lactone include α-ethyl lactone, α-acetolactone, β-propiolactone, γ-butyrolactone, δ-valerolactone, δ-caprolactone, ζ-enanthiolactone, η-caprylolactone, γ-valerolactone, γ-heptalactone, γ-nonalactone, β-methyl-δ-valerolactone, 2-butyl-2-ethylpropiolactone, α,α-diethylpropiolactone. Among the substances, γ-butyrolactone is particularly preferable. In a case where a recording medium is a film made of a vinyl chloride resin or the like, lactone permeates an ink into the recording medium, and thus the adhesiveness can be improved.

Examples of glycol ethers include ethylene glycol monoisobutyl ether, ethylene glycol monohexyl ether, ethylene glycol monoisohexyl ether, diethylene glycol monohexyl ether, triethylene glycol monohexyl ether, diethylene glycol monoisohexyl ether, triethylene glycol monoisohexyl ether, ethylene glycol monoisoheptyl ether, diethylene glycol monoisoheptyl ether, triethylene glycol monoisoheptyl ether, ethylene glycol monooctyl ether, ethylene glycol monoisooctyl ether, diethylene glycol monoisooctyl ether, triethylene glycol monoisooctyl ether, ethylene glycol mono-2-ethylhexyl ether, diethylene glycol mono-2-ethylhexyl ether, triethylene glycol mono-2-ethylhexyl ether, diethylene glycol mono-2-ethylpentyl ether, ethylene glycol mono-2-ethylpentyl ether, ethylene glycol mono-2-ethylhexyl ether, diethylene glycol mono-2-ethylhexyl ether, ethylene glycol mono-2-methylpentyl ether, diethylene glycol mono-2-methyl pentyl ether, propylene glycol monobutyl ether, dipropylene glycol monobutyl ether, tripropylene glycol monobutyl ether, propylene glycol monopropyl ether, dipropylene glycol monopropyl ether, and tripropylene glycol monomethyl ether.

The organic solvent may be singly used or may be used in mixture of two kinds or more. When the organic solvent is blended in the treatment solution, in a case where the treatment solution is used as an aqueous ink, the content of the organic solvent is preferably from 0.5 mass % to 45 mass % in total, with respect to the total mass (100 mass %) of the treatment solution. The content of the organic solvent is more preferably from 1.0 mass % to 40 mass %, particularly preferably from 2.0 mass % to 35 mass %, and further particularly preferably from 2.0 mass % to 30 mass %. In a case where the treatment solution is used as a non-aqueous ink, the content of the organic solvent can be set to be from 70 mass % to 90 mass % in total, with respect to the total mass of the treatment solution.

In a case where the treatment solution is adhered to a recording medium by the ink jet method, the content of an organic solvent having a boiling point of 280° C. or higher is preferably equal to or smaller than 5 mass %, more preferably equal to or smaller than 3 mass %, further preferably equal to or smaller than 2 mass %, particularly preferably equal to or smaller than 1 mass %, and further particularly preferably equal to or smaller than 0.5 mass %. The reason of the above range is that an action of thickening the treatment solution in the vicinity of the ink jet head may occur by such an organic solvent absorbing moisture, and thus discharge stability of the ink jet head may be deteriorated. Therefore, if the content of an organic solvent having a standard boiling point of 280° C. or higher is set to be within the above range, it is possible to obtain discharge stability. Further, regarding various recording media, particularly, a non-ink absorbent or low ink-absorbent recording medium, dryability of an image on the recording medium is improved. Thus, it is possible to form an image in which image quality is excellent by suppressing an occurrence of bleeding and suppressing uneven density of the image. In addition, it is possible to form an image having excellent abrasion resistance.

Examples of the organic solvent having a boiling point of 280° C. or higher can include glycerin. Since glycerin has high hygroscopicity and a high boiling point, glycerin may act as the cause of clogging or operation failure of an ink jet head. Glycerin has poor antiseptic properties and causes mold and fungi to easily propagate. Thus, it is preferable that glycerin be not contained.

Surfactant

The treatment solution used in the embodiment may contain a surfactant. If the treatment solution contains the surfactant, it is possible to reduce surface tension of the treatment solution, and thus to improve wettability into a recording medium. In a case where the treatment-solution adhering step is performed in the ink jet method, it is possible to secure discharge reliability in recording. Among surfactants, for example, a nonionic surfactant such as an acetylene glycol surfactant, a silicone surfactant, and a fluorine surfactant can be preferably used.

The acetylene glycol surfactant is not particularly limited. For example, one substance or more selected from 2,4,7,9-tetramethyl-5-decyne-4,7-diol, an alkylene oxide adduct of 2,4,7,9-tetramethyl-5-decyne-4,7-diol, 2,4-dimethyl-5-decyne-4-ol, and an alkylene oxide adduct of 2,4-dimethyl-5-decyne-4-ol are preferable.

Examples of the commercial product of the acetylene glycol surfactant include OLFINE 104 series or OLFINE E series (for example, E1010) (product names, manufactured by Nissin Chemical Industry Co., Ltd.), Surfynol 465, Surfynol 61, and Surfynol DF110D (product names, manufactured by Air Products and Chemicals. Inc.), Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (above all product names, manufactured by Air Products and Chemicals. Inc.), OLFINE B, Y, P, A, STG, SPC, E1004, E1010, PD-001, PD-002W, PD-003, PD-004, EXP.4001, EXP.4036, EXP.4051, AF-103, AF-104, AK-02, SK-14, and AE-3 (above all product names, manufactured by Nissin Chemical Industry Co., Ltd.), ACETYLENOL E00, E00P, E40, and E100 (above all product names, manufactured by Kawaken Fine Chemicals Co., Ltd.).

The silicone surfactant is not particularly limited. For example, a polysiloxane surfactant and polyether-modified organosiloxane are exemplified. The commercial product of the silicone surfactant is not particularly limited. Specifically, BYK-306, BYK-307, BYK-333, BYK-341, BYK-345, BYK-346, BYK-347, BYK-348, and BYK-349 (above product names, manufactured by BYK Additives & Instruments Inc.), and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (above product names, manufactured by Shin-Etsu Chemical Co., Ltd.) are exemplified.

The fluorine surfactant is particularly limited. For example, perfluoroalkyl sulfonate, perfluoroalkyl carboxylate, perfluoroalkyl phosphate ester, perfluoroalkylethylene oxide adducts, perfluoroalkyl betaine, and perfluoroalkylamine oxide compounds are exemplified. The commercial product of the fluorine surfactant is not particularly limited. Examples of the commercial product of the fluorine surfactant include SURFLON 5144 and 5145 (above product names, manufactured by AGC SEIMI CHEMICAL CO., LTD.); FC-170C, FC-430, and Fluorad FC4430 (above product names, manufactured by 3M Japan Ltd.); FSO, FSO-100, FSN, FSN-100, and FS-300 (above product names, manufactured by Dupont Inc.); and FT-250 and 251 (above product names, manufactured by NEOS COMPANY).

As the fluorine surfactant, fluorine-modified polymers can be used. As the specific example thereof, BYK-340 (manufactured by BYK Additives & Instruments) is exemplified.

Further, as other nonionic surfactants, for example, the followings may be used: polyoxyethylene alkyl ether, polyoxyethylene alkyl phenyl ether, alkyl glucoside, polyoxyalkylene glycol alkyl ether, polyoxyalkylene glycol, polyoxyalkylene glycol alkyl phenyl ether, sucrose fatty acid ester, polyoxyethylene fatty acid ester, polyoxyethylene sorbitan fatty acid ester, sorbitan fatty acid ester polyoxyalkylene glycol alkylamine, polyoxyethylene alkylamine, polyoxyethylene alkylamine oxide, fatty acid alkanol amide, alkylol amide, polyoxyethylene polyoxypropylene block polymers, 2,4,7,9-tetramethyl-5-decyne-4,7-diol, alkylene oxide adducts of 2,4,7,9-tetramethyl-5-decyne-4,7-diol, 2,4-dimethyl-5-decyne-4-ol, alkylene oxide adducts of 2,4-dimethyl-5-decyne-4-ol, perfluoroalkyl sulfonate, perfluoroalkyl carboxylate, perfluoroalkyl phosphate ester, perfluoroalkylethylene oxide adducts, perfluoroalkyl betaine, and perfluoroalkylamine oxide compounds.

The commercial products of the other nonionic surfactants are not particularly limited. Examples of the commercial products thereof include ADEKA TOL TN-40, TN-80, TN-100, LA-675B, LA-775, LA-875, LA-975, LA-1275, and OA-7 (above product names, manufactured by ADEKA CORPORATION), CL-40, CL-50, CL-70, CL-85, CL-95, CL-100, CL-120, CL-140, CL-160, CL-200, and CL-400 (above product names, manufactured by Sanyo Chemical Industries, Ltd.), NOIGEN XL-40, -41, -50, -60, -6190, -70, -80, -100, -140, -160, -160S, -400, -400D, and -1000, NOIGEN TDS-30, -50, -70, -80, -100, -120, -200D, and -500F, NOIGEN EA-137, -157, -167, -177, -197D, DKS NL-30, -40, -50, -60, -70, -80, -90, -100, -110, -180, and -250, NOIGEN ET-89, -109, -129, -149, -159, and -189, NOIGEN ES-99D, -129D, -149D, and -169D, SORGEN TW-20, -60, -80V, and -80, DK ESTER F-160, -140, -110, -90, and -70 (above product names, manufactured by DKS Co. Ltd.), LATEMUL PD-450, PD-420, PD-430, and PD-4305, RHEODOL TW-L106, TW-L120, TW-P120, TW-S106V, TW-S120V, TW-S320V, TW-O106V, TW-O120V, and TW-O320V, RHEODOL 430V, 440V, and 460V, RHEODOL SUPER SP-L10 and TW-L120, EMANON 1112, 3199V, 4110V, 3299RV, and 3299V, EMULGEN 109P, 1020, 123P, 130K, 147, 150, 210P, 220, 306P, 320P, 350, 404, 408, 409PV, 420, 430, 1108, 1118S-70, 1135S-70, 1150S-60, 4085, A-60, A-90, A-500, and B-66 (above product names, manufactured by Kao Corporation.).

The treatment solution may contain surfactants other than the nonionic surfactant, in a range without impairing the function of the above-described coagulant. For example, ionic surfactants such as an anionic surfactant or an amphoteric surfactant are exemplified. One or two or more kinds of surfactants which have been exemplified may be blended in the treatment solution.

In a case using the surfactant, the content of the surfactant in total is preferably from 0.1 mass % to 10 mass %, with respect to the total mass (100 mass %) of the treatment solution, more preferably from 0.25 mass % to 5 mass %, and further preferably from 0.5 mass % to 2 mass %.

Other Components

If necessary, a pH adjuster, a sterilizer or antifungal agent, a rust inhibitor, a chelating agent, and the like may be added to the treatment solution used in the embodiment.

5.1.2. Preparation of Treatment Solution

The treatment solution used in the embodiment can be manufactured by dispersing and mixing the above-described components with an appropriate method. The treatment solution can be prepared in a manner that the components are sufficiently stirred, and then, if necessary, filtering is performed.

5.1.3. Physical Properties of Treatment Solution

In a case where the treatment solution used in the embodiment is discharged from the ink jet head, surface tension of the treatment solution at 20° C. is preferably from 18 mN/m to 40 mN/m, more preferably from 20 mN/m to 35 mN/m, and further preferably from 22 mN/m to 33 mN/m. The surface tension can be measured, for example, in a manner that surface tension when a platinum plate is wetted with the treatment solution under an environment of 20° C. is checked by using an automatic surface tensiometer CBVP-Z (product name, manufactured by Kyowa Interface Science Co., LTD.).

From the similar viewpoint, viscosity of the treatment solution used in the embodiment, at 20° C., is preferably from 3 mPa·s to 10 mPa·s, and more preferably from 3 mPa·s to 8 mPa·s. The viscosity can be measured, for example, in a manner that the viscosity under an environment of 20° C. is measured by using a viscoelasticity tester MCR-300 (product name, manufactured by Pysica Corporation).

5.1.4. Form of Adhering Treatment Solution

In the treatment-solution adhering step, the treatment solution is adhered to a recording medium P. This step can be performed by any or a combination of a non-contact type method and a contact type method, for example, an ink jet method, a method of adhering the treatment solution to the recording medium P by using various sprays, a method of adhering the treatment solution to the recording medium P by immersing the recording medium P into the treatment solution, and a method of adhering the treatment solution to the recording medium P with a brush or the like. If the ink jet method is selected among the above methods, it is easy to select a region in which an image is formed on the recording medium P, and to adhere the treatment solution to the region. Thus, it is possible to reduce waste of the treatment solution. If the ink jet method is used, for example, a period until the ink composition is adhered after the treatment solution has been adhered is easily controlled. Thus, using the ink jet method is preferable.

In the treatment-solution adhering step, the treatment solution is adhered to a region which includes the image region C (first region A and second region B) in which an image is finally formed on the recording medium, in plan view. The region to which the treatment solution is adhered may be the same as the image region C or wider than the image region C, so long as the treatment solution is adhered to the image region C.

In the treatment-solution adhering step, the adhesion amount of the treatment solution to the image region C (first region A and second region B) also depends on the adhesion amount of an ink composition to be adhered to this region. For example, the adhesion amount of the treatment solution is preferably from 2 mg/inch$^2$ to 20 mg/inch$^2$. The lower limit of the adhesion amount is more preferably equal to or greater than 5 mg/inch$^2$. The upper limit of the adhesion amount is more preferably equal to or smaller than 15 mg/inch$^2$, and further preferably equal to or smaller than 10 mg/inch$^2$. Since the adhesion amount of the treatment solution is equal to or greater than 2 mg/inch$^2$, the occurrence of unevenness tends to be suppressed more. Since the adhesion amount of the treatment solution is equal to or smaller than 20 mg/inch$^2$, it is possible to suppress the decrease of adhesiveness and to suppress the decrease of abrasion resistance.

In the treatment-solution adhering step, the adhesion amount of the treatment solution adhered to the recording medium P is preferably from 5 mass % to 20 mass % of the total adhesion amount of the white ink composition and the non-white ink composition in each of the first region A and the second region B.

According to such an adhesion amount, the amount of the treatment solution in a region in which the ink composition is adhered is more proper. Thus, it is possible to record an image in which both the shielding property in the second region B (white region) and the coloring property in the first region A (non-white region) are further excellent and the scratch resistance of the entirety of the image is highly maintained.

The treatment-solution adhering step may be performed before the white-ink adhering step and the non-white-ink adhering step, may be performed simultaneously with any one or both of the white-ink adhering step and the non-white-ink adhering step, and may be performed after the white-ink adhering step and the non-white-ink adhering step. Among these cases, if the treatment-solution adhering step is performed before the white-ink adhering step and the non-white-ink adhering step which will be described later, it is possible to cause the reaction between the treatment solution and the ink compositions more reliably. Even in a case where the treatment solution and the ink composition are discharged from the nozzle row near to the ink jet head, if arrangement of the nozzle row, the scanning direction of the ink jet head, the transporting direction of the recording medium P, and the like are adjusted so as to adhere the treatment solution to the recording medium P before the ink composition, it is possible to cause the reaction between the treatment solution and the ink compositions more reliably.

5.2. White-Ink Adhering Step

The white-ink adhering step is a step of adhering the white ink composition including the white color material to the recording medium P. The white ink composition and the white-ink adhering step will be described below. A region to which the white ink composition is adhered on the recording medium P by this step is the first region A and the second region B. In the first region A, the non-white ink composition is adhered by the non-white-ink adhering step. In the second region B, the non-white ink composition is not adhered, and thus a white image is formed.

In the recording method in the embodiment, the white-ink adhering step and the non-white-ink adhering step are performed by performing scanning in which the relative position between the recording medium P and the ink jet head is changed while the ink compositions are discharged from the ink jet head (ink jet method). Thus, it is possible to form a high-definition image.

5.2.1. White Ink Composition

The white ink composition is used for forming an underlayer of the non-white ink composition in the first region A and is used for forming a white image in the second region B. For example, in a case where the color of the non-white ink composition is similar to the color of the recording medium P or a recording medium P having low brightness is used, recognizing an image may have difficulty even though an image formed of the non-white ink composition is formed on the recording medium P. In such a case, if the underlayer formed of the white ink composition is formed on the recording medium P by using the white ink composition, it is possible to improve visibility of the image which is formed of the non-white ink composition and is formed on the underlayer. For example, in a case where a non-white ink composition containing a color pigment (yellow ink, magenta ink, cyan ink, and the like) or a black ink containing a black pigment is used as the non-white ink composition, if the recording medium P has a black color or is transparent or translucent, recognizing an image formed of the non-white ink composition has difficulty. In such a case, for example, if an image (underlayer) formed of the white ink composition including the white color material is formed on the recording medium, it is possible to improve visibility of an image formed of the non-white ink composition.

White Color Material

The white ink composition contains the white color material. The white color material (white color material) is not limited to the following. Examples of the white color material include white inorganic pigments such as titanium oxide, zinc oxide, zinc sulfide, antimony oxide, and zirconium oxide. In addition to the white inorganic pigment, a white organic pigment such as white hollow resin particles and white polymer particles can be used.

The color index (C.I.) of the white pigment is not limited to the following. Examples thereof include C.I.Pigment White 1 (basic lead carbonate), 4 (zinc oxide), 5 (mixture of zinc sulfide and barium sulfate), 6 (titanium oxide), 6:1 (titanium oxide containing other metal oxides), 7 (zinc sulfide), 18 (calcium carbonate), 19 (clay), 20 (titanium mica), 21 (barium sulfate), 22 (natural barium sulfate), 23 (gross white), 24 (alumina white), 25 (gypsum), 26 (magnesium oxide.silicon oxide), 27 (silica), and 28 (anhydrous calcium silicate). Among the substances, titanium oxide is preferable from a point of excellent coloring property, concealment, and visibility (brightness).

Among the titanium oxides, a common rutile type titanium oxide is preferable as the white pigment. The rutile type titanium oxide may be directly produced or may be commercially available. The well-known sulfuric acid method and chlorine method in the related art are exemplified as an industrial production method of directly producing the rutile type titanium oxide (powder shape). Examples of the commercial product of the cationic polyallylamine resin include the rutile type of Tipaque (registered trademark) CR-60-2, CR-67, R-980, R-780, R-850, R-980, R-630, R-670, PF-736, and the like (above product name, manufactured by ISHIHARA SANGYO KAISHA, LTD.).

As the white color material, for example, a material formed from secondary particles (or high-order particles) formed by aggregating a plurality of primary particles having an average particle size which is smaller than 200 nm is desirable. The average particle size of the secondary particle is from 200 nm to 1 μm, preferably from 200 nm to 800 nm, and more preferably from 200 nm to 500 nm.

In a case of including the secondary particles as the white color material, the secondary particles can be more easily coagulated by an action of the treatment solution applied on the recording medium P. Before the action of the treatment solution is applied, the secondary particles are hardly coagulated. That is, the secondary particle before coagulation has properties of being porous, and thus sedimentation can be suppressed. In addition, the secondary particle before coagulation has a particle size which is smaller than that of the secondary particle after coagulation. Thus, a discharging property when the secondary particles are discharged from the nozzles of the ink jet recording apparatus is also excellent. The secondary particles after coagulation are densely arranged on the recording medium P. Thus, whiteness of a white image which is recorded is highly improved. Since the secondary particles are densely arranged on the recording medium P, it is possible to reduce the occurrence of bleeding of a white image which is recorded.

The white ink composition may contain a single white color material or plural kinds of white color materials. The content (in terms of solid content) of the white color material in the white ink composition is preferably from 1 mass % to 20 mass % in total, with respect to the total mass of the white ink composition, and more preferably from 5 mass % to 15 mass %. Since the content of the white color material is within the above range, a white ink composition having excellent dispersibility is easily obtained, and an image having excellent coloring property and concealment is easily obtained.

The white ink composition may contain components as follows in addition to the white color material.

Resin

The white ink composition may contain a resin. The resin can be used for improving physical strength of an image to be recorded, such as abrasion resistance. As such a resin, well-known resins as follows and a polyolefin wax are exemplified: acrylic resin, styrene acrylic resin, fluorene resin, urethane resin, polyolefin resin, rosin modified resin, terpene resin, polyester resin, polyamide resin, epoxy resin, vinyl chloride resin, vinyl chloride-vinyl acetate copolymer resin, and ethylene vinyl acetate resin. The resin may be singly used or may be used in combination of two kinds or more.

Among the above-exemplified resins, acrylic resin, styrene acrylic resin, polyester resin, urethane resin, and polyolefin wax can be preferably used.

The acryl resin is a resin including at least a (meth)acrylic monomer as a monomer constituting the resin. The content of the monomer is preferably equal to or greater than 20 mass % with respect to the entirety of monomers, and further preferably equal to or greater than 40%, 50%, 70%, and 80%. As the (meth)acrylic monomer, (meth) acrylic acid and (meth) acrylate are exemplified. As the (meth) acrylate, alkyl (meth)acrylate, alicyclic alkyl (meth)acrylate, aromatic (meth)acrylate, and the like are exemplified.

The commercial product of the acryl resin is not particularly limited. Examples thereof include MOWINYL 7320 (product name, manufactured by Nippon Synthetic Chemical Industry Co., Ltd.), MICROGEL E-1002 and MICROGEL E-5002 (product names, manufactured by NIPPON-PAINT Co., Ltd.), VONCOAT 4001 and VONCOAT 5454 (product names, manufactured by DIC CORPORATION), SAE1014 (product name, manufactured by ZEON CORPORATION), SAIBINOL SK-200 (product name, manufactured by Saiden Chemical Industry Co., Ltd.), Joncryl 7100, Joncryl 390, Joncryl 711, Joncryl 511, Joncryl 7001, Joncryl 632, Joncryl 741, Joncryl 450, Joncryl 840, Joncryl 62J, Joncryl 74J, Joncryl HRC-1645J, Joncryl 734, Joncryl 852, Joncryl 7600, Joncryl 775, Joncryl 537J, Joncryl 1535, Joncryl PDX-7630A, Joncryl 352J, Joncryl 352D, Joncryl PDX-7145, Joncryl 538J, Joncryl 7640, Joncryl 7641, Joncryl 631, Joncryl 790, Joncryl 780, and Joncryl 7610 (product names, manufactured by BASF Japan Ltd.), and NK Binder R-5HN (product name, manufactured by Shin-Nakamura Chemical Co., Ltd.).

Examples of the styrene acrylic resin include styrene-acrylic acid copolymers, styrene-methacrylic acid copolymers, styrene-methacrylic acid-acrylic acid ester copolymers, styrene-α-methylstyrene-acrylic acid copolymers, and styrene-α-methylstyrene-acrylic acid-acrylic acid ester copolymers. As the form of the copolymer, any form of random copolymer, block copolymer, alternating copolymer, graft copolymer can be used. As the styrene acrylic resin, a commercial product may be used. Examples of the commercial product of the cationic polyallylamine resin include Joncryl 62J (product name, manufactured by BASF Japan Ltd.) and Polysol AM-610 (product name, manufactured by SHOWA DENKO Corporation).

As the polyester resin, a commercial product can be used. For example, Eastek 1100, 1300, and 1400 (product names, manufactured by Eastman Chemical Company) and ELITEL KA-5034, KA-3556, KA-1449, KT-8803, KA-5071S, KZA-1449S, KT-8701, and KT9204 (product names, manufactured by UNITIKA Ltd.) are exemplified.

The urethane resin is a resin having at least a urethane bond in the skeleton of the resin. As the urethane resin, a urethane resin having at least any of a polyether skeleton, a polycarbonate skeleton, and a polyester skeleton is preferable. The commercial product of the urethane resin is not particularly limited. Examples of the commercial product of the urethane resin include Sancure 2710 (product name, manufactured by Lubrizol Corporation), PERMARIN UA-150 (product name, manufactured by Sanyo Chemical Industries, Ltd.), SUPERFLEX 460, 470, 610, and 700 (product names, manufactured by DKS Co. Ltd.), NeoRez R-9660, R-9637, and R-940 (product names, manufactured by Kusumoto Chemicals, Ltd.), ADEKA BONTIGHTER HUX-380 and 290K (product names, manufactured by ADEKA CORPORATION), and TAKELAC (registered trademark) W-605, W-635, and WS-6021 (product names, manufactured by Mitsui Chemicals, Inc.).

Examples of the polyolefin wax include waxes produced from olefin such as ethylene, propylene, and butylene or derivatives thereof, copolymers thereof. Specifically, polyethylene wax, polypropylene wax, polybutylene wax, and the like are exemplified. Among the waxes, from a viewpoint of being capable of reducing an occurrence of cracking an image, the polyethylene wax is preferable. The polyolefin wax may be singly used or may be used in combination of two kinds or more.

As the commercial product of the polyolefin wax, CHEMIPEARL series such as CHEMIPEARL W4005 (product name, manufactured by Mitsui Chemicals, Inc., polyethylene wax) are exemplified. In addition, AQUACER series such as AQUACER 503, 507, 513, 515, and 840 (product names, manufactured by BYK Additives & Instruments, polyethylene wax), Hitec series such as HiTec E-7025P, E-2213, E-9460, E-9015, E-4A, E-5403P, and E-8237 (product names, manufactured by TOHO CHEMICAL INDUSTRY Co., Ltd.), NOPCOTE PEM-17 (product name, manufactured by SAN NOPCO LIMITED, Polyethylene emulsion), and the like are exemplified. The above products are commercially available in a form of an aqueous emulsion in which a polyolefin wax is dispersed in water by a conventional method.

The above resin may be singly used or may be used in combination of plural kinds thereof. In a case where the resin is contained in the white ink composition, the content (in terms of solid content) of the resin is preferably from 1 mass % to 10 mass %, and more preferably from 1 mass % to 7 mass %, in total, with respect to the total mass of the white ink composition.

The content of the white color material in a case using the resin is preferably from 0.2 times to 20 times the content of the resin in terms of solid content, and more preferably from one time to 10 times. If the content of the white color material is within the above range, favorable fixability of the white color material to the recording medium is obtained. Thus, abrasion resistance of an obtained image is easily improved.

From a viewpoint of being capable of improving abrasion resistance of a film, adhesiveness, and storage stability of an ink, it is preferable that the resin be supplied in a form of an emulsion. In a case where the resin is contained in the white ink in the embodiment, the resin may be a self-emulsifying type in which a hydrophilic component required for being stably dispersed in water is introduced or may come to being water dispersible by using an external emulsifier. From a viewpoint of not hindering a reaction with the coagulant included in the treatment solution, the resin is more preferably a self-emulsifying dispersion (self-emulsifying type emulsion) which does not include an emulsifier.

Solvent

The white ink composition can contain one or more selected from water and an organic solvent, as a solvent. In a case where the white ink composition contains water as the solvent, the white ink composition is used as a so-called aqueous ink. In a case where the white ink composition does not contain water, the white ink composition is used as a so-called non-aqueous ink.

In the specification, an expression of "do not include X" substantially means that X is not intentionally added when a composition is produced, or substantially means that X as much as an intention to add X is sufficiently achieved is added. As a specific example of "not including X", for example, cases of not including 1.0 mass % or greater of X, preferably, not including 0.5 mass % or greater of X, more preferably, not including 0.1 mass % or greater of X, further preferably, not including 0.05 mass % or greater of X, particularly preferably 0.01 mass % or greater of X, and further particularly preferably, not including 0.001 mass % or greater of X are provided.

Both of water and the organic solvent are similar to the descriptions of the section of the treatment solution. Thus, descriptions thereof will not be repeated. In a case where the white ink composition is an aqueous ink, for example, the content of the water can be set to be equal to or greater than 50 mass % with respect to the total mass of the white ink composition.

Surfactant

The white ink composition may contain a surfactant. The surfactant has a function of improving wettability to a recording medium by reducing surface tension and improving. Among surfactants, for example, an acetylene glycol surfactant, a silicone surfactant, and a fluorine surfactant can be preferably used. The surfactant is similar to the descriptions of the section of the treatment solution. Thus, descriptions thereof will not be repeated. In a case of containing the surfactant, the content of the surfactant is preferably from 0.1 mass % to 1.5 mass % in total, with respect to the total mass of the white ink composition.

Other Components

The white ink composition may contain, if necessary, a thickener, a polymerizable compound, a pH adjuster, a sterilizer or antifungal agent, a rust inhibitor, a chelating agent, and the like.

5.2.2. Physical Properties of White Ink Composition

From a viewpoint of balance between image quality and reliability for being applied to the ink jet recording apparatus, the white ink composition in the embodiment has surface tension at 20° C., which is preferably from 20 mN/m to 40 mN/m, and more preferably from 25 mN/m to 35 mN/m. The surface tension can be measured, for example, in a manner that surface tension when a platinum plate is wetted with the ink under an environment of 20° C. is checked by using an automatic surface tensiometer CBVP-Z (product name, manufactured by Kyowa Interface Science Co., LTD.).

From the similar viewpoint, viscosity of the white ink composition at 20° C. in the embodiment is preferably from 3 mPa·s to 10 mPa·s, and more preferably from 3 mPa·s to 8 mPa·s. The viscosity can be measured, for example, in a manner that the viscosity under an environment of 20° C. is measured by using a viscoelasticity tester MCR-300 (product name, manufactured by Pysica Corporation).

5.2.3. Form of Adhering White Ink Composition

In the white-ink adhering step, the white ink composition is adhered to the recording medium P by using the ink jet method. That is, the white-ink adhering step is performed by performing scanning in which the relative position between the recording medium P and the ink jet head is changed while the ink composition is discharged from the ink jet head. In the white-ink adhering step, the white ink composition is adhered to the image region C (first region A and second region B) in which an image is finally formed on the recording medium P. In the white-ink adhering step, the total adhesion amount of the white ink composition to the first region A is, for example, from 8 mg/inch$^2$ to 25 mg/inch$^2$. The lower limit of the adhesion amount is preferably equal to or greater than 10 mg/inch$^2$, and more preferably equal to or greater than 15 mg/inch$^2$. The upper limit of the adhesion amount is preferably equal to or smaller than 20 mg/inch$^2$, and more preferably equal to or smaller than 18 mg/inch$^2$.

Since the total adhesion amount of the white ink composition in the first region A is equal to or greater than 8 mg/inch$^2$, it is possible to form an image in which background concealment is sufficient and the coloring property of the non-white ink composition is sufficient. Since the total adhesion amount of the white ink composition is equal to or smaller than 25 mg/inch$^2$, it is possible to sufficiently perform a reaction with the treatment solution, and to suppress deterioration of adhesiveness between the recording medium and an image.

In the white-ink adhering step, the total adhesion amount of the white ink composition to the second region B is, for example, from 9 mg/inch$^2$ to 36 mg/inch$^2$. The lower limit of the adhesion amount is preferably equal to or greater than 10 mg/inch$^2$, and more preferably equal to or greater than 15 mg/inch$^2$. The upper limit of the adhesion amount is preferably equal to or smaller than 30 mg/inch$^2$, and more preferably equal to or smaller than 20 mg/inch$^2$.

Since the total adhesion amount of the white ink composition in the second region B is equal to or greater than 9 mg/inch$^2$, it is possible to form a white image having sufficient background concealment. Since the total adhesion amount of the white ink composition is equal to or smaller than 36 mg/inch$^2$, it is possible to sufficiently perform a reaction with the treatment solution, and to suppress deterioration of adhesiveness between the recording medium P and an image. In a case where adhering is performed by performing the scanning plural times, the total adhesion amount of the white ink composition to the second region is set as the total adhesion amount of the white ink composition when scanning is performed plural times. In a case where adhering is performed by performing scanning once, the white ink composition of the total adhesion amount may be adhered in one scanning. The above descriptions are similarly applied to a case of the first region A.

The adhesion amount of the ink composition is obtained by dividing the total discharge amount (mg) of the ink composition which has been adhered to a region formed with the ink composition in the ink adhering step, by the area (inch$^2$) of the region.

For the white-ink adhering step, a wet-on-wet method in which the white ink composition is adhered without completely drying the treatment solution after the treatment solution has been adhered in the treatment-solution adhering step is preferably employed. Specifically, it is preferable that the white ink composition be adhered in a state where the volatile component remaining rate of the treatment solution adhered to the image region C is equal to or greater than 40 mass %. The wet-on-wet method has an advantage in that it is possible to reduce a recording time as much as the treatment solution is not dried. Since the white ink composition to be adhered later is adhered in a state where drying the composition to be previously adhered is more proper, it is possible to easily diffuse the treatment solution into the composition to be adhered later, and to sufficiently cause the reaction. Thus, it is possible to further suppress an occurrence of blurring between the composition to be previously adhered and the white ink composition to be adhered later.

The wet-on-wet method can also be defined in accordance with a time from when a liquid to be previously adhered until the next liquid is adhered. It is preferable that, after a time interval of 1 second to 120 seconds elapses from when a liquid (any of treatment solution, white ink composition, and non-white ink composition) adhered before the white-ink adhering step is adhered, the white ink composition be adhered by the next white-ink adhering step. According to such a range, the wet-on-wet method can be realized. Thus, at least some of the components of the liquid to be previously adhered are easily diffused by the white ink composition to be adhered later. Therefore, for example, in a case where the treatment solution is previously adhered to the recording medium P, coagulation of the white color material is more easily caused. Thus, it is possible to form an image having more favorable background concealment.

From such a viewpoint, the time interval from when the liquid has been adhered before the white-ink adhering step until the white ink composition is adhered is preferably equal to or longer than 1 second, more preferably equal to or longer than 2 seconds, and further preferably equal to or longer than 3 seconds. The upper limit thereof is preferably equal to or shorter than 90 seconds, more preferably equal to or shorter than 60 seconds, further preferably equal to or shorter than 30 seconds, particularly preferably equal to or shorter than 20 seconds, and further particularly preferably equal to or shorter than 10 seconds.

Such a time interval can be adjusted by, for example, adjusting a moving speed of the carriage having the ink jet head mounted therein or a waiting time of the carriage because the white-ink adhering step is performed by the ink jet method. Alternatively, the transporting speed of the recording medium may be adjusted, the number of nozzles in the nozzle row used in recording may be adjusted, or a distance between the heads in the sub-scanning direction may be adjusted. If the time interval is equal to or longer than the lower limit, it is possible to accelerate drying of the ink to be previously adhered. Thus, image quality is particularly excellent. If the time interval is equal to or shorter than the upper limit, it is possible to prevent an occurrence of a situation in which the reaction of the ink to be previously adhered with the treatment solution proceeds too much, and thus it is not possible to cause the ink to be adhered later to sufficiently react with the treatment solution. Thus, the image quality is particularly excellent. In addition, according to the embodiment, the embodiment is useful because the recording speed can increase, and it is possible to secure sufficient image quality.

The time difference (time interval) can be defined at a specific position in the image region C. However, more clearly, for example, in a case where recording is performed by performing scanning plural times, if the ink composition is adhered to a specific position (set as position A) in the sub-scanning direction, which is a position including the center of the recording medium P in the scanning direction (main scanning direction), and is a position in the image, the time difference may be set as a time from when adhering the previous liquid to the position A is completed until adhering the later ink composition at the position A starts.

In a case where recording is performed by performing scanning once, the time difference may be set as a time from when adhering the previous liquid to a predetermined position on the recording medium P is completed until adhering the later ink composition to this position starts.

5.3. Non-White-Ink Adhering Step

The non-white-ink adhering step is a step of adhering the non-white ink composition including the non-white color material to the recording medium P. The non-white ink composition and the non-white-ink adhering step will be described below. A region to which the non-white ink composition is adhered on the recording medium P by this step is the first region A, and a non-white image is formed. Since the white ink layer 20 is formed as a base in the first region A, a non-white image having favorable background concealment and coloring property is formed.

In the recording method in the embodiment, the non-white-ink adhering step is performed by preforming scanning in which the relative position between the recording medium P and the ink jet head is changed while the non-white ink composition is discharged from the ink jet head (ink jet method). Thus, it is possible to form a high-definition image.

5.3.1. Non-White Ink Composition

The non-white ink composition contains at least a non-white color material.

Non-White Color Material

A dye or a pigment may be used as a color material included in the non-white ink composition. From a point of color fixing or coagulation thickening by the treatment solution, the pigment is preferably used. As the pigment, any of an organic pigment and an inorganic pigment can be used. The color material included in the non-white ink composition is selected to have a color different from the color of the white ink composition.

The non-white color material refers to a color material other than the above-described white color materials. A non-white pigment is not limited to the followings. For example, organic pigments (Brilliant Carmine 6B, Lake Red C, Watching Red, Disazo Yellow, Hansa Yellow, Phthalocyanine Blue, Phthalocyanine Green, Alkali Blue, Aniline Black, and the like) of an azo type, a phthalocyanine type, a dye type, a condensed polycyclic type, a nitro type, a nitroso type, and the like, metals such as cobalt, iron, chromium, copper, zinc, lead, titanium, vanadium, manganese, and nickel, metal oxides, metal sulfides, carbon black (C.I.Pigment Black 7) series such as furnace carbon black, lamp black, acetylene black, and channel black, and inorganic pigments such as ocher, navy blue, and Prussian blue can be used.

More specifically, examples of carbon black which can be used as the black pigment include MCF88, No. 2300, 2200B, 900, 33, 40, 45, 52, MA7, 8, and 100 (above product names, manufactured by Mitsubishi Chemical Corporation), Raven 5750, 5250, 5000, 3500, 1255, and 700 (above product names, manufactured by Columbia Carbon Corporation), REGAL 400R, 330R, 660R, Mogul L, Monarch 700, 800, 880, 900, 1000, 1100, 1300, and 1400 (above product names, manufactured by Cabot Corporation), Color Black FW1, FW2, FW2V, FW18, FW200, S150, 5160, 5170, Printex 35, U, V, 140U, Special Black 6, 5, 4A, and 4 (above product names, manufactured by Evonik Industries AG).

Examples of yellow pigments include C.I.Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of magenta pigments include C.I.Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245, and C.I.Pigment Violet 19, 23, 32, 33, 36, 38, 43, and 50.

Examples of cyan pigments include C.I.Pigment Blue 1, 2, 3, 15, 15:1, 15:2, 15:3, 15:34, 15:4, 16, 18, 22, 25, 60, 65, and 66.

Examples of pigments other than magenta, cyan, and yellow include C.I.Pigment Green 7 and 10, C.I.Pigment Brown 3, 5, 25, and 26, C.I.Pigment Orange 1, 2, 5, 7, 13, 14, 15, 16, 24, 34, 36, 38, 40, 43, and 63.

The pigment as exemplified above may be singly used or may be used in combination of two kinds or more. Pigments other than the above-exemplified pigments can be appropriately used.

The content of the non-white color material included in the non-white ink composition varies depending on the type of the color material to be used. However, from a point of securing favorable coloring property, the content of the non-white color material is preferably from 1 mass % to 30 mass % in total, with respect to the total mass of the non-white ink composition, more preferably from 5 mass % to 15 mass %, and further preferably from 5 mass % to 12 mass %.

From a viewpoint of improving dispersibility in the non-white ink composition, the pigment may be a pigment subjected to surface treatment or may be a pigment using a dispersing agent and the like. The pigment subjected to surface treatment means a pigment (also referred to as "a self-dispersing pigment" below) obtained in a manner that a hydrophilic group (such as a carboxyl group and a sulfonic acid group) is directly or indirectly bonded to the surface of the pigment by a physical treatment or a chemical treatment, so as to be capable of being dispersed in an aqueous solvent. The pigment using the dispersing agent means a pigment (also referred to as "a polymer dispersion pigment" below) obtained by dispersing the pigment with a dispersing resin or a dispersing agent. Any well-known substance may be used as the surfactant or the resin. "The polymer dispersion pigment" also includes a pigment coated with a resin. The pigment coated with the resin can be obtained by an acid precipitation method, a phase inversion emulsification method, an emulsion polymerization method, and the like.

Other Components

The non-white ink composition can include a resin, a solvent, a surfactant, and other component, similar to the above-described white ink composition. As the components, the components exemplified for the white ink composition can be used, and the contents thereof can be set to be in the similar ranges. Thus, descriptions thereof will not be repeated.

5.3.2. Physical Properties of Non-White Ink Composition

It is preferable that the non-white ink composition in the embodiment have physical properties similar to those of the above-described white ink composition, from a viewpoint of image quality and reliability for being applied to the ink jet recording apparatus.

5.3.3. Form of Adhering Non-White Ink Composition

In the non-white-ink adhering step, the non-white ink composition is adhered to the recording medium P by using the ink jet method. That is, the non-white-ink adhering step is performed by performing scanning in which the relative position between the recording medium P and the ink jet head is changed while the non-white ink composition is discharged from the ink jet head. In the non-white-ink adhering step, the non-white ink composition is adhered to the first region A in which an image is finally formed on the recording medium P. In the non-white-ink adhering step, the total adhesion amount of the non-white ink composition to the first region A is, for example, from 5 mg/inch$^2$ to 30 mg/inch$^2$. The lower limit of the adhesion amount is preferably equal to or greater than 7 mg/inch$^2$, and more preferably equal to or greater than 10 mg/inch$^2$. The upper limit of the adhesion amount is preferably equal to or smaller than 25 mg/inch$^2$, more preferably equal to or smaller than 20 mg/inch$^2$, further preferably equal to or smaller than 16 mg/inch$^2$, and particularly preferably equal to or smaller than 13 mg/inch$^2$. It is preferable that the total adhesion amount of the non-white ink composition be set to be within the above range in maximum.

Since the total adhesion amount of the non-white ink composition in the first region A is equal to or greater than 5 mg/inch$^2$, it is possible to form an image having a sufficient coloring property of the non-white ink composition. Since the total adhesion amount of the non-white ink composition is equal to or smaller than 30 mg/inch$^2$, it is possible to sufficiently perform a reaction with the treatment solution. In addition, since the components of the treatment solution are consumed by the reaction, it is possible to suppress deterioration of adhesiveness between the recording medium P and an image and to suppress deterioration of sticking resistance occurring by poor drying of the ink.

For the non-white-ink adhering step preferably, a wet-on-wet method in which the non-white ink composition is adhered without completely drying the white ink composition after the white ink composition has been adhered in the white-ink adhering step is preferably employed. If the wet-on-wet method is defined by a time from when the white ink composition or the non-white ink composition to be previously adhered is adhered until the next non-white ink composition is adhered, it is preferable that the non-white ink composition be adhered by the next non-white-ink adhering step at a time interval of one second to 120 seconds after the liquid (any of white ink composition and non-white ink composition) adhered before the non-white-ink adhering step. According to such a range, the wet-on-wet method can be realized. Thus, for example, the components of the treatment solution are easily diffused by the non-white ink composition to be adhered later, via the ink composition which has been previously adhered. Therefore, for example, in a case where the treatment solution is previously adhered to the recording medium P, coagulation of the non-white color material is more easily caused. Thus, it is possible to form an image having a more favorable coloring property. With this configuration, the later composition is adhered in a state where the liquid which has been previously adhered is more properly dried. Thus, it is possible to easily diffuse the treatment solution in the composition to be adhered later and to sufficiently cause a reaction between the treatment solution and the composition. Accordingly, it is possible to further suppress an occurrence of blurring between the composition to be previously adhered and the composition to be adhered later.

From such a viewpoint, the time interval from when the ink composition has been adhered before the non-white-ink adhering step until the non-white ink composition is adhered is preferably from 1.5 seconds to 90 seconds, more preferably from 2 seconds to 60 seconds, and further preferably from 2 seconds to 30 seconds. Such a time interval can be easily achieved by, for example, adjusting a moving speed of the carriage having the ink jet head mounted therein or a waiting time of the carriage because the non-white-ink adhering step is performed by the ink jet method.

5.4. Heating Step

The recording method in the embodiment may include a heating step. The heating step is a step of heating a recording medium P. If the recording method includes the heating step, for example, it is possible to reduce a time for recording or to improve dryability of an image.

A heating method used in the heating step is not particularly limited. For example, a conduct ion method of conducting heat from a member in contact with a recording medium to the recording medium, a radiation method of radiating radiation such as an infrared ray, which generates heat, to the recording medium, a convection method of sending heat containing air to recording medium, or combinations of the above methods are provided.

As the heating step, for example, a first heating step and a second heating step are exemplified. In the first heating step, the recording medium P is heated before or simultaneously with the white-ink adhering step and the non-white-ink adhering step which have been described above. In the second heating step, the recording medium P is heated after recording ends.

The surface temperature (reaching temperature) of the recording medium at time of being heated is preferably from 30° C. to 45° C. in the first heating step. In this case, the lower limit temperature is more preferably 32° C., and further preferably 35° C. The upper limit temperature is more preferably 40° C., and further preferably 38° C. With this configuration, the reaction between the ink composition to be adhered and the treatment solution is more accelerated. Thus, it is possible to perform recording at a much higher speed.

The surface temperature (reaching temperature) of the recording medium at time of being heated is preferably from 50° C. to 110° C. in the second heating step. In this case, the lower limit temperature is more preferably 70° C., and further preferably 80° C. The upper limit temperature is more preferably 100° C., and further preferably 90° C. If the recording medium has the temperature of this extent is obtained, in a case where each of the inks includes the resin, the ink can be fused, and moisture can be evaporated. Thus, it is possible to obtain a recorded matter which can be used early.

5.5. Advantageous Effects

According to the recording method in the embodiment, it is possible to easily record an image including the first region (region in which two-layer printing is performed by overlapping the white ink and the non-white ink) A and the second region (region formed with only the white ink) B, by using the treatment solution. Since one or both of Conditions (i) and (ii) is satisfied, it is possible to record an image in which both a shielding property in the second region (white region) B and a coloring property in the first region (non-white region) A are excellent and scratch resistance of the entirety of the image is highly maintained.

6. Image Formed by Recording Method in Modification Example

Figure 2:
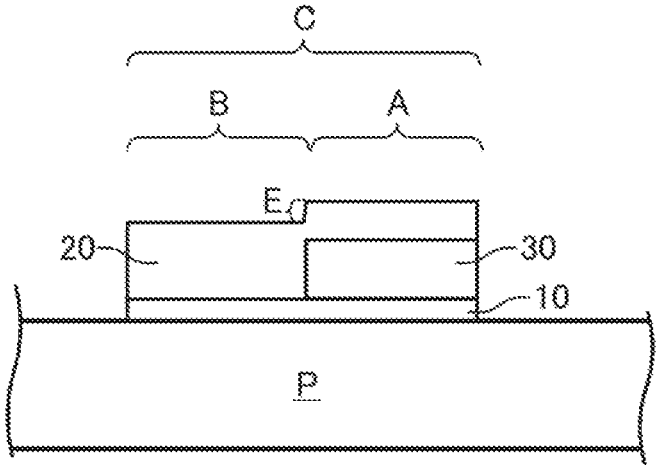
FIG. 2 is a schematic diagram illustrating an image formed by a recording method according to a modification example of the embodiment.

FIG. 2 is a schematic diagram illustrating an image formed by a recording method according to a modification example of the embodiment. Similar to the embodiment, in the recording method in the modification example, as illustrated in FIG. 2, an image region C is formed on a recording medium P. The image region C includes a first region A in which a white ink composition and a non-white ink composition are adhered and a second region B in which the white ink composition is adhered, and the non-white ink composition is not adhered. Thus, the image region C includes a non-white first region A and a white second region B.

In the modification example, the first region A is formed in a manner that the non-white ink layer 30 obtained by adhering the non-white ink composition and the white ink layer 20 obtained by adhering the white ink composition are stacked. In the second region B, only the white ink layer 20 obtained by adhering the white ink composition is formed.

Also in FIG. 2, the height (thickness) of each layer conceptually indicates the adhesion amount of the adhered ink composition. Also in the recording method in the modification example, the height of the first region A may be equal to or different from the height of the second region B. In the example of FIG. 2, the first region A is illustrated to have a height which is higher than that of the second region B (see E in FIG. 2). However, the height of the first region A may be lower than that of the second region B. That is, the total adhesion amount of the white ink composition and the non-white ink composition to the first region A may be equal to or different from the total adhesion amount of the white ink composition to the second region B. In any case, the image region C is formed such that the total adhesion amount of the white ink composition in the first region A is smaller than the total adhesion amount of the white ink composition in the second region B. That is, also in the modification example, the adhesion amount of the white ink composition has a relationship of the first region A< the second region B (this state may be referred to as "Condition (i)" below).

The adhesion amount or the adhesion timing of the ink composition for recording a recorded matter having a structure according to the modification example can be appropriately determined based on the form of the above-described embodiment. Thus, detailed descriptions will be omitted. According to the recorded matter in the modification example, in a case where the recording medium P is transparent or translucent, it is possible to recognize an image from the recording medium P side. Similar to the recorded matter in the above embodiment, it is possible to easily record an image including the first region (region in which two-layer printing is performed by overlapping the white ink and the non-white ink) and the second region (region formed with only the white ink), by using the treatment solution. Since one or both of Conditions (i) and (ii) is satisfied, it is possible to record an image in which both a shielding property in the second region (white region) and a coloring property in the first region (non-white region) are excellent and scratch resistance of the entirety of the image is highly maintained.

In the recording method in the embodiment, even though any of the white ink composition or the non-white ink composition is adhered on a side close to the recording medium P on the recording surface of the recording medium P, the first region A can correspond to both a case where an image recorded on a recorded matter is displayed on the recording surface side of the recording medium P and a case where the image is displayed on an opposite side of the recording surface.

7. Examples and Comparative Examples

The invention will be more specifically described with examples, but the invention is not limited to the examples.

7.1. Preparation of Treatment Solution and Ink Composition

After dispersion treatment of the color material had been performed, components were put into a container so as to obtain composition ratios in Table 1. After the components were mixed and stirred with a magnetic stirrer for 2 hours, filtering was performed with a membrane filter having a hole diameter of 5 μm. Thus, treatment solutions, white ink compositions, and non-white ink compositions used in the examples and comparative examples were obtained. The numerical value in Table 1 indicates mass %.

TABLE 1

| | | TREATMENT SOLUTION 1 | TREATMENT SOLUTION 2 | TREATMENT SOLUTION 3 | WHITE INK COMPOSITION | NON-WHITE INK COMPOSITION |
|---|---|---|---|---|---|---|
| COAGULANT | MAGNESIUM SULFATE | 7 | — | — | — | — |
| | CATIONIC POLYMER | — | 4 | — | — | — |
| | MALONIC ACID | — | — | 7 | — | — |
| WHITE COLOR MATERIAL | TITANIUM DIOXIDE | — | — | — | 10 | — |
| NON-WHITE COLOR MATERIAL | CYAN | — | — | — | — | 4 |
| RESIN | STYRENE TYPE | — | — | — | 5 | 3 |
| WAX | POLYETHYLENE TYPE | — | — | — | 2 | 1 |
| SOLVENT | 2-PYRROLIDONE | 15 | 15 | 15 | 10 | 15 |
| | PROPYLENE GLYCOL | 10 | 10 | 10 | 10 | 10 |
| SURFACTANT | SILOXANE TYPE | 1 | 1 | 1 | 1 | 1 |
| WATER | ION EXCHANGE WATER | REMAINING | REMAINING | REMAINING | REMAINING | REMAINING |
| | TOTAL | 100 | 100 | 100 | 100 | 100 |

In Table 1, titanium dioxide which was manufactured by ISHIHARA SANGYO KAISHA, LTD. and had an average particle size of 250 nm was used. The cyan pigment is C.I.Pigment Blue 15:3 (PB15:3). The resin is a styrene acrylic resin emulsion ("Polysol AM-610" manufactured by SHOWA DENKO Corporation). The wax is a polyethylene wax "AQUACER515" manufactured by BYK Corporation. The surfactant is a siloxane surfactant "BYK348" manufactured by BYK Corporation. The cationic polymer is a polyamine resin (Catiomaster PD-7 manufactured by Yokkaichi Chemical Company). As the resin, a resin in a state of being dispersed by a dispersing resin was used. A dispersing agent of the styrene acrylic resin is added to the pigment, and thus is used for dispersing the pigment, but is not described in Table. In a case where the pigment is a cyan pigment, 0.5 parts by mass of the dispersing agent of the styrene acrylic resin are added to 1 parts by mass of the pigment. In a case where the pigment is a titanium dioxide, 0.1 parts by mass of the dispersing agent of the styrene acrylic resin are added to 1 parts by mass of the pigment. Firstly, the pigment was mixed with the dispersing resin, the mixture was dispersed in water by a bead mill, and thereby a pigment dispersion liquid was prepared. Then, an ink was prepared by using the pigment dispersion liquid and other components.

7.2. Evaluation Method 7.2.1. Production of Recorded Matter

A machine obtained by modifying SC-S30650 (manufactured by Seiko Epson Corporation) was prepared as the ink jet recording apparatus. The platen heater was set to be capable of adjusting the temperature. The surface temperature of a recording medium ("IJ8150" manufactured by 3M Corporation, transparent vinyl chloride sheet (non-absorbent medium)) when the treatment solution or the ink composition was to be adhered was set to be a primary heating temperature in Table. In the example of 25° C., the heater was set to be off.

As illustrated in FIG. 3, a head configuration (head set) in which the three ink jet head having a plurality of nozzle rows were arranged in a direction of the nozzle row extending. In the direction of the nozzle row extending, the arrangement was made such that the ink jet heads overlapped each other when viewed from an orthogonal direction, and the nozzle interval in the nozzle row was not cut off when viewed from the orthogonal direction.

Each nozzle row had nozzle density of 360 dpi. The number of nozzles in each nozzle row was set to 360. Regarding the recording resolution in a recording pattern, the pixel was set to be the maximum of 720 dpi×1440 dpi for each reaction solution or ink composition. Dots were thinned out or arranged in plural, in the pixel such that the adhesion amount of the treatment solution or the ink composition in Tables 2 to 7, and the dots were arranged as uniformly as possible in the recording pattern.

In an example using the white ink composition and the non-white ink composition, for each example according to Table, the second and third ink jet head from the upstream side (based on the transporting direction of the recording medium as a reference) among the three ink jet heads were respectively filled with a white ink composition and a non-white ink composition or were respectively filled with a non-white ink composition and a white ink composition.

For each example according to Table, the first or second ink jet head from the upstream side (based on the transporting direction of the recording medium as a reference) among the three ink jet heads was filled with a treatment solution. That is, for each example according to Table, in a case where the treatment solution had been adhered before adhering for the first layer, nozzles in a nozzle row of the first ink jet head were filled with the treatment solution. In a case where the treatment solution was adhered simultaneously with adhering the ink composition for the first layer, nozzles in a nozzle row of the second ink jet head were filled with the treatment solution.

A recording medium was fed to a printer, and recording was performed by alternately performing main scanning (scanning) and sub-scanning which is paper transporting, by a carriage in which the ink jet heads (head set) were mounted. A distance when sub-scanning is performed once is shorter than the length of one head. Firstly, a reaction solution was adhered to a recording portion. While recording proceeded, the white ink composition and the non-white ink composition were adhered to overlap each other. Regarding an example in which the order of adhering the ink composition was reversed, the ink composition with which the head set was filled was replaced, and then the above steps were performed.

A time between main scanning and the next main scanning was adjusted such that a time from when the last white ink composition was adhered to the recording portion positioned at the center of the recording medium in the main scanning direction until the first non-white ink composition was adhered to the above recording portion came to the time in Table. The time was adjusted by adjusting a carriage speed, a suspension time between scanning and the next scanning, or a distance between the heads in the sub-scanning direction.

In the example in which one ink layer was formed by performing scanning plural times, for each first layer and each second layer, the adhesion amount of the ink composition for each scanning was adhered as equally as possible. However, a slight difference occurs. For the maximum adhesion amount in one scanning, the adhesion amount per one scanning of the layer for which the adhesion amount per one scanning was more among the first layer and the second layer was described.

After recording, the recording medium was secondarily heated at a secondary dry temperature in Table by an after-heater on the downstream of the platen. After secondary heating, the recording portion of the recording medium, on which recording was completed stayed at room temperature for one day. Then, evaluations as follows were performed.

The outline of the reading method of Tables 2 to 7 will be described in accordance with Example 1. In Example 1, firstly, scanning was performed once or plural times so as to adhere Treatment Solution 1 by 3.4 mg/inch$^2$ in the first region and 3.6 mg/inch$^2$ in the second region. For the first ink layer, the white ink composition was adhered to the first region and the second region 8 times. At this time, adhering was performed such that the maximum adhesion amount (maximum discharge amount) per one scanning was 2.3 mg/inch$^2$, and the total adhesion amount was 18 mg/inch$^2$. With a time interval of 20 seconds, the non-white ink composition was adhered to the first region 8 times for the second ink layer, and the white ink composition was adhered to the second region 8 times for the second ink layer. At this time, adhering of the non-white ink composition was performed such that the maximum adhesion amount per one scanning was 2 mg/inch$^2$, and the total adhesion amount was 16 mg/inch$^2$. Adhering of the white ink composition was performed such that the maximum adhesion amount per one scanning was 2.3 mg/inch$^2$, and the total adhesion amount was 18 mg/inch$^2$. The treatment solution timing and the dry temperature are as described in Table. Condition (i) and Condition (ii) indicate conditions described in this specification.

7.2.2. Evaluation of L* Value

Colorimetry was performed on a white portion (second region) of the obtained recorded matter by a spectrophotometer CM-700d manufactured by Konica Minolta Co., Ltd., so as to obtain the L* value. Evaluation was performed for the obtained L* value based on criteria as follows, and then the results were described in Table.

A: 80 or greater

B: 78 or greater and smaller than 80

C: smaller than 78

7.2.3. Evaluation of Shielding Property

The white portion (second region) of the obtained recorded matter was visually evaluated, and the results were described in Table.

A: light of a fluorescent lamp is not seen when seeing the fluorescent lamp separated at 3 m through a printing surface B: light of a fluorescent lamp is slightly seen when seeing the fluorescent lamp separated at 3 m through a printing surface C: light of a fluorescent lamp is clearly seen when seeing the fluorescent lamp separated at 3 m through a printing surface 7.2.4. Recording Quality Evaluation for quality was performed based on criteria as follows by using the solid surfaces of the white portion (second region) and a non-white portion (first region) of the obtained recorded matter, and then the results were described in Table.

A: no unevenness of density in the solid surface and no accumulation of the ink at the edge B: unevenness of density in the solid surface does not occur, but accumulation of the ink at the edge slightly occurs C: unevenness of density in the solid surface and accumulation of the ink at the edge occur together 7.2.5. Evaluation of Abrasion Resistance Evaluation was performed based on criteria as follows, and then the results were described in Table.

A: peeling does not occur when rubbing with a load of 500 g 10 times in a graduation scratch resistance test B: peeling occurs in a region of an area within 10% of the evaluation area when rubbing with the load of 500 g 10 times in the graduation scratch resistance test C: peeling occurs in a region of 10% or greater of the evaluation area when rubbing with the load of 500 g 10 times in the graduation scratch resistance test 7.2.6. Stickiness Evaluation of Recording Surface The recording surface and a back surface of a recording medium of the same type were stuck to each other in a state of overlapping each other, and then stayed at 35° C. for one day. Evaluation was performed based on criteria as follows, and then the results were described in Table.

A: no stickiness when the media stayed in a state where the printing surface was overlapped B: stickiness occurs when the media stayed in a state where the printing surface was overlapped, but peeling of the recording portion does not occur C: stickiness and peeling of the recording portion occur together when the media stayed in a state where the printing surface was overlapped 7.2.7. Clogging Test A pattern of 5 cm×5 cm was recorded on a recording medium of the A4 size as much as possible by arranging the pattern in the center of the recording medium in the main scanning direction with a gap in the sub-scanning direction. The recording test continued for 50 sheets, and then a discharge state of a nozzle in a nozzle row after the recording was evaluated. It was confirmed whether or not a situation in which the solution was not discharged occurred or it was confirmed whether or not the position at which the dot was landed was shifted from the normal position by a distance of ⅓ or greater of the distance between the adjacent nozzles. Evaluation was performed based on criteria as follows, and then the results were described in Table.

A: not-discharge or a position shift does not occur even though printing is performed on 50 sheets B: position shift occurs if printing is performed on 50 sheets C: not-discharge occurs if printing is performed on 50 sheets

TABLE 2

| | | EXAMPLE 1 | | | EXAMPLE 2 | | | EXAMPLE 3 | | | EXAMPLE 4 | | | EXAMPLE 5 | | | EXAMPLE 6 | | |
|---|---|---|---|---|---|---|---|---|---|---|---|---|---|---|---|---|---|---|---|
| | | TREATMENT SOLUTION No. | | | | | | | | | | | | | | | | | |
| | | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | |
| | | INK LAYER | | | | | | | | | | | | | | | | | |
| | | SECOND REGION | FIRST REGION | | SECOND REGION | FIRST REGION | | SECOND REGION | FIRST REGION | | SECOND REGION | FIRST REGION | | SECOND REGION | FIRST REGION | | SECOND REGION | FIRST REGION | |
| | | WHITE | WHITE | NON-WHITE | WHITE | WHITE | NON-WHITE | WHITE | WHITE | NON-WHITE | WHITE | WHITE | NON-WHITE | WHITE | WHITE | NON-WHITE | WHITE | WHITE | NON-WHITE |
| ADHESION AMOUNT (mg/inch$^2$) | TREATMENT SOLUTION | 3.6 | 3.4 | | 3.6 | 3.4 | | 3.6 | 3.4 | | 3.6 | 3.4 | | 1.8 | 1.7 | | 7.2 | 6.8 | |
| | FIRST INK LAYER | 18 | 18 | — | 27 | 27 | — | 18 | 18 | — | 18 | 18 | — | 18 | 18 | — | 18 | 18 | — |
| | SECOND INK LAYER | 18 | — | 16 | 9 | — | 7 | 18 | — | 16 | 18 | — | 16 | 18 | — | 16 | 18 | — | 16 |
| | FIRST AND SECOND LAYERS | 36 | 34 | | 36 | 34 | | 36 | 34 | | 36 | 34 | | 36 | 34 | | 36 | 34 | |
| RATIO OF ADHESION AMOUNT (TREATMENT SOLUTION/INK) | | 10% | 10% | | 10% | 10% | | 10% | 10% | | 10% | 10% | | 5% | 5% | | 20% | 20% | |
| NUMBER OF TIMES OF SCANNING (TIMES) | FIRST INK LAYER | 8 | 8 | — | 8 | 8 | — | 8 | 8 | — | 8 | 8 | — | 8 | 8 | — | 8 | 8 | — |
| | SECOND INK LAYER | 8 | — | 8 | 8 | — | 8 | 8 | — | 8 | 8 | — | 8 | 8 | — | 8 | 8 | — | 8 |
| MAXIMUM ADHESION AMOUNT IN ONE SCANNING (mg/inch$^2$/SCANNING) | | 2.3 | 2.3 | 2 | 3.4 | 3.4 | 0.9 | 2.3 | 2.3 | 2 | 2.3 | 2.3 | 2 | 2.3 | 2.3 | 2 | 2.3 | 2.3 | 2 |
| TREATMENT SOLUTION TIMING | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | |
| TIME INTERVAL (SECONDS) FROM END OF ADHERING FOR FIRST INK LAYER TO START OF ADHERING FOR SECOND INK | | 20 | | | 20 | | | 3 | | | 60 | | | 20 | | | 20 | | |
| PRIMARY DRY LAYER TEMPERATURE (° C.) | | 35 | | | 35 | | | 35 | | | 35 | | | 35 | | | 35 | | |
| SECONDARY DRY TEMPERATURE (° C.) | | 80 | | | 80 | | | 80 | | | 80 | | | 80 | | | 80 | | |
| WHETHER OR NOT CONDITION (i) IS | | ○ | | | ○ | | | ○ | | | ○ | | | ○ | | | ○ | | |

TABLE 2-continued

| | EXAMPLE 1 | | | EXAMPLE 2 | | | EXAMPLE 3 | | | EXAMPLE 4 | | | EXAMPLE 5 | | | EXAMPLE 6 | | |
|---|---|---|---|---|---|---|---|---|---|---|---|---|---|---|---|---|---|---|
| | TREATMENT SOLUTION No. | | | | | | | | | | | | | | | | | |
| | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | |
| | INK LAYER | | | | | | | | | | | | | | | | | |
| | SECOND | FIRST REGION | | SECOND | FIRST REGION | | SECOND | FIRST REGION | | SECOND | FIRST REGION | | SECOND | FIRST REGION | | SECOND | FIRST REGION | |
| | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| SATISFIED WHETHER OR NOT CONDITION (ii) IS SATISFIED | | ○ | | | ○ | | | ○ | | | ○ | | | ○ | | | ○ | |
| EVALUATION RESULT | | | | | | | | | | | | | | | | | | |
| L* VALUE | A | — | | A | — | | A | — | | A | — | | A | — | | A | — | |
| SHIELDING PROPERTY | A | — | | A | — | | A | — | | A | — | | A | — | | A | — | |
| WHITE SOLID QUALITY | A | — | | B | — | | A | — | | A | — | | B | — | | A | — | |
| NON-WHITE SOLID QUALITY | — | A | | — | B | | — | B | | — | B | | — | B | | — | A | |
| ABRASION RESISTANCE | A | A | | A | A | | A | A | | A | A | | A | A | | B | B | |
| STICKINESS OF RECORDING SURFACE | B | B | | B | B | | B | B | | B | B | | B | B | | B | B | |
| CLOGGING TEST TREATMENT SOLUTION | | A | | | A | | | A | | | A | | | A | | | A | |
| WHITE INK | | B | | | B | | | B | | | B | | | B | | | B | |
| NON-WHITE INK | | A | | | A | | | A | | | A | | | A | | | A | |

TABLE 3

| | | EXAMPLE 7 | | | EXAMPLE 8 | | | EXAMPLE 9 | | | EXAMPLE 10 | | | EXAMPLE 11 | | | EXAMPLE 12 | | |
|---|---|---|---|---|---|---|---|---|---|---|---|---|---|---|---|---|---|---|---|
| | | TREATMENT SOLUTION No. | | | | | | | | | | | | | | | | | |
| | | TREATMENT SOLUTION 1 | | | TREATMENT SOLUTION 2 | | | TREATMENT SOLUTION 3 | | | TREATMENT SOLUTION 1 | | | TREATMENT SOLUTION 1 | | | TREATMENT SOLUTION 1 | | |
| | | INK LAYER | | | | | | | | | | | | | | | | | |
| | | SECOND | FIRST REGION | | SECOND | FIRST REGION | | SECOND | FIRST REGION | | SECOND | FIRST REGION | | SECOND | FIRST REGION | | SECOND | FIRST REGION | |
| | | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| ADHESION AMOUNT (mg/inch$^2$) | TREATMENT SOLUTION | 3.6 | 3.4 | | 3.6 | 3.4 | | 3.6 | 3.4 | | 3.6 | 3.4 | | 3.6 | 3.4 | | 3.6 | 3.4 | |
| | FIRST INK LAYER | 18 | 18 | — | 18 | 18 | — | 18 | 18 | — | 18 | — | 16 | 18 | 18 | — | 18 | 18 | — |
| | SECOND INK LAYER | 18 | — | 16 | 18 | — | 16 | 18 | — | 16 | 18 | 18 | — | 18 | — | 16 | 18 | — | 16 |
| | FIRST AND SECOND LAYERS | 36 | 34 | | 36 | 34 | | 36 | 34 | | 36 | 34 | | 36 | 34 | | 36 | 34 | |
| RATIO OF ADHESION AMOUNT (TREATMENT SOLUTION/INK) | | 10% | 10% | | 10% | 10% | | 10% | 10% | | 10% | 10% | | 10% | 10% | | 10% | 10% | |
| NUMBER OF TIMES OF SCANNING (TIMES) | FIRST INK LAYER | 8 | 8 | — | 8 | 8 | — | 8 | 8 | — | 8 | 8 | — | 8 | 8 | — | 8 | 8 | — |
| | SECOND INK LAYER | 8 | — | 8 | 8 | — | 8 | 8 | — | 8 | 8 | — | 8 | 8 | — | 8 | 8 | — | 8 |
| MAXIMUM ADHESION AMOUNT IN ONE SCANNING (mg/inch$^2$/SCANNING) | | 2.3 | 2.3 | 2 | 2.3 | 2.3 | 2 | 2.3 | 2.3 | 2 | 2.3 | 2.3 | 2 | 2.3 | 2.3 | 2 | 2.3 | 2.3 | 2 |
| TREATMENT SOLUTION TIMING | | AT SAME TIME FOR INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | |
| TIME INTERVAL (SECONDS) FROM END OF ADHERING FOR FIRST INK LAYER TO START OF ADHERING FOR SECOND INK LAYER | | 20 | | | 20 | | | 20 | | | 20 | | | 20 | | | 20 | | |
| PRIMARY DRY TEMPERATURE (° C.) | | 35 | | | 35 | | | 35 | | | 35 | | | 25 | | | 35 | | |
| SECONDARY DRY TEMPERATURE (° C.) | | 80 | | | 80 | | | 80 | | | 80 | | | 80 | | | 70 | | |
| WHETHER OR NOT | | ○ | | | ○ | | | ○ | | | ○ | | | ○ | | | ○ | | |

TABLE 3-continued

| | EXAMPLE 7 | | | EXAMPLE 8 | | | EXAMPLE 9 | | | EXAMPLE 10 | | | EXAMPLE 11 | | | EXAMPLE 12 | | |
|---|---|---|---|---|---|---|---|---|---|---|---|---|---|---|---|---|---|---|
| | TREATMENT SOLUTION No. | | | | | | | | | | | | | | | | | |
| | TREATMENT SOLUTION 1 | | | TREATMENT SOLUTION 2 | | | TREATMENT SOLUTION 3 | | | TREATMENT SOLUTION 1 | | | TREATMENT SOLUTION 1 | | | TREATMENT SOLUTION 1 | | |
| | INK LAYER | | | | | | | | | | | | | | | | | |
| | SECOND | FIRST REGION | | SECOND | FIRST REGION | | SECOND | FIRST REGION | | SECOND | FIRST REGION | | SECOND | FIRST REGION | | SECOND | FIRST REGION | |
| | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| CONDITION (i) IS SATISFIED WHETHER OR NOT CONDITION (ii) IS SATISFIED | | ○ | | | ○ | | | ○ | | | ○ | | | ○ | | | ○ | |
| EVALUATION RESULT | | | | | | | | | | | | | | | | | | |
| L* VALUE | A | — | | A | — | | A | — | | A | — | | A | — | | A | — | |
| SHIELDING PROPERTY | A | — | | A | — | | A | — | | A | — | | A | — | | A | — | |
| WHITE SOLID QUALITY | B | — | | A | — | | A | — | | A | — | | B | — | | A | — | |
| NON-WHITE SOLID QUALITY | — | B | | — | A | | — | B | | — | A | | — | B | | — | A | |
| ABRASION RESISTANCE | A | A | | A | A | | B | B | | A | A | | A | A | | B | B | |
| STICKINESS OF RECORDING SURFACE | B | B | | B | B | | B | B | | B | B | | B | B | | B | B | |
| CLOGGING TEST TREATMENT SOLUTION | | A | | | A | | | A | | | A | | | A | | | A | |
| WHITE INK | | B | | | B | | | B | | | B | | | A | | | B | |
| NON-WHITE INK | | A | | | A | | | A | | | A | | | A | | | A | |

TABLE 4

| | | EXAMPLE 13 | | | EXAMPLE 14 | | | EXAMPLE 15 | | | EXAMPLE 16 | | | EXAMPLE 17 | | | EXAMPLE 18 | | |
|---|---|---|---|---|---|---|---|---|---|---|---|---|---|---|---|---|---|---|---|
| | | TREATMENT SOLUTION No. | | | | | | | | | | | | | | | | | |
| | | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | |
| | | INK LAYER | | | | | | | | | | | | | | | | | |
| | | SECOND REGION | FIRST REGION | | SECOND REGION | FIRST REGION | | SECOND REGION | FIRST REGION | | SECOND REGION | FIRST REGION | | SECOND REGION | FIRST REGION | | SECOND REGION | FIRST REGION | |
| | | WHITE | WHITE | NON-WHITE | WHITE | WHITE | NON-WHITE | WHITE | WHITE | NON-WHITE | WHITE | WHITE | NON-WHITE | WHITE | WHITE | NON-WHITE | WHITE | WHITE | NON-WHITE |
| ADHESION AMOUNT (mg/inch$^2$) | TREATMENT SOLUTION | 2.7 | 3.4 | | 1.8 | 2.8 | | 2.7 | 3.4 | | 2.7 | 3.4 | | 1.35 | 1.7 | | 5.4 | 6.8 | |
| | FIRST INK LAYER | 27 | 18 | — | 18 | 12 | — | 27 | 18 | — | 27 | 18 | — | 27 | 18 | — | 27 | 18 | — |
| | SECOND INK LAYER | — | — | 16 | — | — | 16 | — | — | 16 | — | — | 16 | — | — | 16 | — | — | 16 |
| | FIRST AND SECOND LAYERS | 27 | 34 | | 18 | 28 | | 27 | 34 | | 27 | 34 | | 27 | 34 | | 27 | 34 | |
| RATIO OF ADHESION AMOUNT (TREATMENT SOLUTION/INK) | | 10% | 10% | | 10% | 10% | | 10% | 10% | | 10% | 10% | | 5% | 5% | | 20% | 20% | |
| NUMBER OF TIMES OF SCANNING (TIMES) | FIRST INK LAYER | 8 | 8 | — | 8 | 8 | — | 8 | 8 | — | 8 | 8 | — | 8 | 8 | — | 8 | 8 | — |
| | SECOND INK LAYER | — | — | 8 | — | — | 8 | — | — | 8 | — | — | 8 | — | — | 8 | — | — | 8 |
| MAXIMUM ADHESION AMOUNT IN ONE SCANNING (mg/inch$^2$/SCANNING) | | 3.4 | 2.3 | 2 | 2.3 | 1.5 | 2 | 3.4 | 2.3 | 2 | 3.4 | 2.3 | 2 | 3.4 | 2.3 | 2 | 3.4 | 2.3 | 2 |
| TREATMENT SOLUTION TIMING | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | |
| TIME INTERVAL (SECONDS) FROM END OF ADHERING FOR FIRST INK LAYER TO START OF ADHERING FOR SECOND INK LAYER | | 20 | | | 20 | | | 3 | | | 60 | | | 20 | | | 20 | | |
| PRIMARY DRY TEMPERATURE (° C.) | | 35 | | | 35 | | | 35 | | | 35 | | | 35 | | | 35 | | |
| SECONDARY DRY TEMPERATURE (° C.) | | 80 | | | 80 | | | 80 | | | 80 | | | 80 | | | 80 | | |

TABLE 4-continued

| | EXAMPLE 13 | | | EXAMPLE 14 | | | EXAMPLE 15 | | | EXAMPLE 16 | | | EXAMPLE 17 | | | EXAMPLE 18 | | |
|---|---|---|---|---|---|---|---|---|---|---|---|---|---|---|---|---|---|---|
| | TREATMENT SOLUTION No. | | | | | | | | | | | | | | | | | |
| | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | |
| | INK LAYER | | | | | | | | | | | | | | | | | |
| | SECOND | FIRST REGION | | SECOND | FIRST REGION | | SECOND | FIRST REGION | | SECOND | FIRST REGION | | SECOND | FIRST REGION | | SECOND | FIRST REGION | |
| | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| WHETHER OR NOT CONDITION (i) IS SATISFIED | | ○ | | | ○ | | | ○ | | | ○ | | | ○ | | | ○ | |
| WHETHER OR NOT CONDITION (ii) IS SATISFIED | | — | | | — | | | — | | | — | | | — | | | — | |
| EVALUATION RESULT | | | | | | | | | | | | | | | | | | |
| L* VALUE | A | — | | B | — | | A | — | | A | — | | A | — | | A | — | |
| SHIELDING PROPERTY | A | — | | B | — | | A | — | | A | — | | A | — | | A | — | |
| WHITE SOLID QUALITY | B | — | | A | — | | B | — | | B | — | | B | — | | A | — | |
| NON-WHITE SOLID QUALITY | — | A | | — | A | | — | B | | — | B | | — | B | | — | A | |
| ABRASION RESISTANCE | A | A | | A | A | | A | A | | A | A | | A | A | | B | B | |
| STICKINESS OF RECORDING SURFACE | A | A | | A | A | | A | A | | A | A | | A | A | | A | A | |
| CLOGGING TEST TREATMENT SOLUTION | | A | | | A | | | A | | | A | | | A | | | A | |
| CLOGGING TEST WHITE INK | | B | | | B | | | B | | | B | | | B | | | B | |
| CLOGGING TEST NON-WHITE INK | | A | | | A | | | A | | | A | | | A | | | A | |

TABLE 5

| | | EXAMPLE 19 | | | EXAMPLE 20 | | | EXAMPLE 21 | | | EXAMPLE 22 | | | EXAMPLE 23 | | | EXAMPLE 24 | | |
|---|---|---|---|---|---|---|---|---|---|---|---|---|---|---|---|---|---|---|---|
| | | TREATMENT SOLUTION No. | | | | | | | | | | | | | | | | | |
| | | TREATMENT SOLUTION 1 | | | TREATMENT SOLUTION 2 | | | TREATMENT SOLUTION 3 | | | TREATMENT SOLUTION 1 | | | TREATMENT SOLUTION 1 | | | TREATMENT SOLUTION 1 | | |
| | | INK LAYER | | | | | | | | | | | | | | | | | |
| | | SECOND | FIRST REGION | | SECOND | FIRST REGION | | SECOND | FIRST REGION | | SECOND | FIRST REGION | | SECOND | FIRST REGION | | SECOND | FIRST REGION | |
| | | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| ADHESION AMOUNT (mg/inch$^2$) | TREATMENT SOLUTION | 2.7 | 3.4 | | 2.7 | 3.4 | | 2.7 | 3.4 | | 2.7 | 3.4 | | 2.7 | 3.4 | | 2.7 | 3.4 | |
| | FIRST INK LAYER | 27 | 18 | — | 27 | 18 | — | 27 | 18 | — | — | — | 16 | 27 | 18 | — | 27 | 18 | — |
| | SECOND INK LAYER | — | — | 16 | — | — | 16 | — | — | 16 | 27 | 18 | — | — | — | 16 | — | — | 16 |
| | FIRST AND SECOND LAYERS | 27 | 34 | | 27 | 34 | | 27 | 34 | | 27 | 34 | | 27 | 34 | | 27 | 34 | |
| RATIO OF ADHESION AMOUNT (TREATMENT SOLUTION/INK) | | 10% | 10% | | 10% | 10% | | 10% | 10% | | 10% | 10% | | 10% | 10% | | 10% | 10% | |
| NUMBER OF TIMES OF SCANNING (TIMES) | FIRST INK LAYER | 8 | 8 | — | 8 | 8 | — | 8 | 8 | — | — | — | 8 | 8 | 8 | — | 8 | 8 | — |
| | SECOND INK LAYER | — | — | 8 | — | — | 8 | — | — | 8 | 8 | 8 | — | — | — | 8 | — | — | 8 |
| MAXIMUM ADHESION AMOUNT IN ONE SCANNING (mg/inch$^2$/SCANNING) | | 3.4 | 2.3 | 2 | 3.4 | 2.3 | 2 | 3.4 | 2.3 | 2 | 3.4 | 2.3 | 2 | 3.4 | 2.3 | 2 | 3.4 | 2.3 | 2 |
| TREATMENT SOLUTION TIMING | | AT SAME TIME FOR INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | |
| TIME INTERVAL (SECONDS) FROM END OF ADHERING FOR FIRST INK LAYER TO START OF ADHERING FOR SECOND INK LAYER | | 20 | | | 20 | | | 20 | | | 20 | | | 20 | | | 20 | | |
| PRIMARY DRY TEMPERATURE (° C.) | | 35 | | | 35 | | | 35 | | | 35 | | | 25 | | | 35 | | |
| SECONDARY DRY TEMPERATURE (° C.) | | 80 | | | 80 | | | 80 | | | 80 | | | 80 | | | 70 | | |

TABLE 5-continued

| | EXAMPLE 19 | | | EXAMPLE 20 | | | EXAMPLE 21 | | | EXAMPLE 22 | | | EXAMPLE 23 | | | EXAMPLE 24 | | |
|---|---|---|---|---|---|---|---|---|---|---|---|---|---|---|---|---|---|---|
| | TREATMENT SOLUTION No. | | | | | | | | | | | | | | | | | |
| | TREATMENT SOLUTION 1 | | | TREATMENT SOLUTION 2 | | | TREATMENT SOLUTION 3 | | | TREATMENT SOLUTION 1 | | | TREATMENT SOLUTION 1 | | | TREATMENT SOLUTION 1 | | |
| | INK LAYER | | | | | | | | | | | | | | | | | |
| | SECOND | FIRST REGION | | SECOND | FIRST REGION | | SECOND | FIRST REGION | | SECOND | FIRST REGION | | SECOND | FIRST REGION | | SECOND | FIRST REGION | |
| | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| WHETHER OR NOT CONDITION (i) IS SATISFIED | | ○ | | | ○ | | | ○ | | | ○ | | | ○ | | | ○ | |
| WHETHER OR NOT CONDITION (ii) IS SATISFIED | | — | | | — | | | — | | | — | | | — | | | — | |
| EVALUATION RESULT | | | | | | | | | | | | | | | | | | |
| L* VALUE | A | — | | A | — | | A | — | | A | — | | A | — | | A | — | |
| SHIELDING PROPERTY | A | — | | A | — | | A | — | | A | — | | A | — | | A | — | |
| WHITE SOLID QUALITY | B | — | | B | — | | B | — | | B | — | | B | — | | B | — | |
| NON-WHITE SOLID QUALITY | — | B | | — | A | | — | B | | — | A | | — | B | | — | A | |
| ABRASION RESISTANCE | A | A | | A | A | | B | B | | A | A | | A | A | | B | B | |
| STICKINESS OF RECORDING SURFACE | A | A | | A | A | | A | A | | A | A | | A | A | | A | A | |
| CLOGGING TEST TREATMENT SOLUTION | | A | | | A | | | A | | | A | | | A | | | A | |
| WHITE INK | | B | | | B | | | B | | | B | | | A | | | B | |
| NON-WHITE INK | | A | | | A | | | A | | | A | | | A | | | A | |

TABLE 6

| | | EXAMPLE 25 | | | EXAMPLE 26 | | | EXAMPLE 27 | | | EXAMPLE 28 | | | EXAMPLE 29 | | |
|---|---|---|---|---|---|---|---|---|---|---|---|---|---|---|---|---|
| | | TREATMENT SOLUTION No. | | | | | | | | | | | | | | |
| | | TREATMENT SOLUTION 1 | | | TREATMENT SOLUTION 1 | | | TREATMENT SOLUTION 1 | | | TREATMENT SOLUTION 1 | | | TREATMENT SOLUTION 1 | | |
| | | INK LAYER | | | | | | | | | | | | | | |
| | | SECOND | FIRST REGION | | SECOND | FIRST REGION | | SECOND | FIRST REGION | | SECOND | FIRST REGION | | SECOND | FIRST REGION | |
| | | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| ADHESION AMOUNT ($mg/inch^2$) | TREATMENT SOLUTION | 3 | 2.8 | | 2 | 3.6 | | 0.9 | 2.3 | | 3.6 | 3.4 | | 7.2 | 6.8 | |
| | FIRST INK LAYER | 15 | 12 | — | 10 | 20 | — | 9 | 7 | — | 27 | 27 | — | 27 | 27 | — |
| | SECOND INK LAYER | 15 | — | 16 | 10 | — | 16 | | — | 16 | 9 | — | 7 | 9 | — | 7 |
| | FIRST AND SECOND LAYERS | 30 | 28 | | 20 | 36 | | 9 | 23 | | 36 | 34 | | 36 | 34 | |
| RATIO OF ADHESION AMOUNT (TREATMENT SOLUTION/INK) | | 10% | 10% | | 10% | 10% | | 10% | 10% | | 10% | 10% | | 20% | 20% | |
| NUMBER OF TIMES OF SCANNING (TIMES) | FIRST INK LAYER | 8 | 8 | — | 8 | 8 | — | 8 | 8 | — | 8 | 8 | — | 8 | 8 | — |
| | SECOND INK LAYER | 8 | — | 8 | 8 | — | 8 | | — | 8 | 8 | — | 8 | 8 | — | 8 |
| MAXIMUM ADHESION AMOUNT IN ONE SCANNING ($mg/inch^2$/SCANNING) | | 1.9 | 1.5 | 2 | 1.3 | 2.5 | 2 | 1.1 | 0.9 | 2 | 3.4 | 3.4 | 0.9 | 3.4 | 3.4 | 0.9 |
| TREATMENT SOLUTION TIMING | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | |
| TIME INTERVAL (SECONDS) FROM END OF ADHERING FOR FIRST INK LAYER TO START OF ADHERING FOR SECOND INK LAYER | | 20 | | | 20 | | | 20 | | | 20 | | | 20 | | |
| PRIMARY DRY TEMPERATURE (° C.) | | 35 | | | 35 | | | 35 | | | 40 | | | 35 | | |
| SECONDARY DRY TEMPERATURE (° C.) | | 80 | | | 80 | | | 80 | | | 80 | | | 80 | | |
| WHETHER OR NOT CONDITION (i) IS SATISFIED | | ○ | | | — | | | ○ | | | ○ | | | ○ | | |
| WHETHER OR NOT CONDITION (ii) IS SATISFIED | | ○ | | | ○ | | | — | | | ○ | | | ○ | | |
| EVALUATION RESULT | | | | | | | | | | | | | | | | |
| L* VALUE | | A | — | | B | — | | C | — | | A | — | | A | — | |
| SHIELDING PROPERTY | | A | — | | B | — | | C | — | | A | — | | A | — | |
| WHITE SOLID QUALITY | | A | — | | A | — | | A | — | | A | — | | A | — | |
| NON-WHITE SOLID QUALITY | | — | A | | — | B | | — | A | | — | A | | — | A | |
| ABRASION RESISTANCE | | A | A | | A | A | | C | B | | A | A | | B | C | |
| STICKINESS OF RECORDING SURFACE | | A | A | | A | A | | A | A | | B | B | | B | C | |
| CLOGGING TEST | TREATMENT SOLUTION | | A | | | A | | | A | | | B | | | A | |
| | WHITE INK | | B | | | B | | | B | | | B | | | B | |
| | NON-WHITE INK | | A | | | A | | | A | | | B | | | A | |

TABLE 7

| | | COMPARATIVE EXAMPLE 1 | | | COMPARATIVE EXAMPLE 2 | | | COMPARATIVE EXAMPLE 3 | | | COMPARATIVE EXAMPLE 4 | | | COMPARATIVE EXAMPLE 5 | | |
|---|---|---|---|---|---|---|---|---|---|---|---|---|---|---|---|---|
| | | TREATMENT SOLUTION 1 | | | — | | | TREATMENT SOLUTION 1 INK LAYER | | | — | | | TREATMENT SOLUTION 1 | | |
| | | SECOND | FIRST REGION | | SECOND | FIRST REGION | | SECOND | FIRST REGION | | SECOND | FIRST REGION | | SECOND | FIRST REGION | |
| | | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| ADHESION AMOUNT (mg/inch2) | TREATMENT SOLUTION | 3.6 | 5 2 | | — | — | | 2.7 | 4 3 | | — | — | | 3.4 | 5 | |
| | FIRST INK LAYER | 36 | 36 | — | 18 | 18 | — | 27 | 27 | — | 27 | 18 | — | 34 | 34 | — |
| | SECOND INK LAYER | — | — | 16 | 18 | — | 16 | — | — | 16 | — | — | 16 | — | — | 16 |
| | FIRST AND SECOND LAYERS | 36 | 52 | | 36 | 34 | | 27 | 43 | | 27 | 34 | | 34 | 50 | |
| RATIO OF ADHESION AMOUNT (TREATMENT SOLUTION/INK) | | 10% | 10% | | — | — | | 10% | 10% | | — | — | | 10% | 10% | |
| NUMBER OF TIMES OF SCANNING (TIMES) | FIRST INK LAYER | 8 | 8 | — | 8 | 8 | — | 8 | 8 | — | 8 | 8 | — | 8 | 8 | — |
| | SECOND INK LAYER | — | — | 8 | 8 | — | 8 | — | — | 8 | — | — | 8 | — | — | 8 |
| MAXIMUM ADHESION AMOUNT IN ONE SCANNING (mg/inch2/SCANNING) | | 4.5 | 4.5 | 2 | 2.3 | 2.3 | 2 | 3.4 | 3.4 | 2 | 3.4 | 2.3 | 2 | 4.3 | 4.3 | 2 |
| TREATMENT SOLUTION TIMING | | BEFORE INK FOR FIRST LAYER | | | BEFORE INK FOR FIRST LAYER | | | BEFORE INK FOR FIRST LAYER | | | BEFORE INK FOR FIRST LAYER | | | BEFORE INK FOR FIRST LAYER | | |
| TIME INTERVAL (SECONDS) FROM END OF ADHERING FOR FIRST INK LAYER TO START OF ADHERING FOR SECOND INK LAYER | | 20 | | | 20 | | | 20 | | | 20 | | | 20 | | |
| PRIMARY DRY TEMPERATURE (° C.) | | 35 | | | 35 | | | 35 | | | 35 | | | 35 | | |
| SECONDARY DRY TEMPERATURE (° C.) | | 80 | | | 80 | | | 80 | | | 80 | | | 80 | | |
| WHETHER OR NOT CONDITION (i) IS SATISFIED | | — | | | ○ | | | — | | | ○ | | | — | | |
| WHETHER OR NOT CONDITION (ii) IS SATISFIED | | — | | | ○ | | | — | | | — | | | — | | |
| EVALUATION RESULT | | | | | | | | | | | | | | | | |
| L* VALUE | | A | — | | B | — | | A | — | | B | — | | A | — | |
| SHIELDING PROPERTY | | A | — | | B | — | | A | — | | B | — | | A | — | |
| WHITE SOLID QUALITY | | C | — | | C | — | | B | — | | C | — | | C | — | |

TABLE 7-continued

| | | COMPARATIVE EXAMPLE 1 | | | COMPARATIVE EXAMPLE 2 | | | COMPARATIVE EXAMPLE 3 TREATMENT SOLUTION No. | | | COMPARATIVE EXAMPLE 4 | | | COMPARATIVE EXAMPLE 5 | | |
|---|---|---|---|---|---|---|---|---|---|---|---|---|---|---|---|---|
| | | TREATMENT SOLUTION 1 | | | — | | | TREATMENT SOLUTION 1 INK LAYER | | | — | | | TREATMENT SOLUTION 1 | | |
| | | SECOND | FIRST REGION | | SECOND | FIRST REGION | | SECOND | FIRST REGION | | SECOND | FIRST REGION | | SECOND | FIRST REGION | |
| | | REGION WHITE | WHITE | NON-WHITE | REGION WHITE | WHITE | NON-WHITE | REGION WHITE | WHITE | NON-WHITE | REGION WHITE | WHITE | NON-WHITE | REGION WHITE | WHITE | NON-WHITE |
| NON-WHITE SOLID QUALITY | | — | C | | — | C | | — | C | | — | C | | — | C | |
| ABRASION RESISTANCE | | B | B | | A | A | | A | B | | A | A | | B | B | |
| STICKINESS OF RECORDING SURFACE | | B | C | | B | B | | A | B | | A | A | | B | C | |
| CLOGGING TEST | TREATMENT SOLUTION | | A | | | A | | | A | | | A | | | A | |
| | WHITE INK | | B | | | B | | | B | | | B | | | B | |
| | NON-WHITE INK | | A | | | A | | | A | | | A | | | A | |

7.3. Evaluation Results

Considering the examples, the following was understood. In all of Examples 1 to 29 in which one or both of Condition (i) and Condition (ii) were satisfied, it was possible to form an image including a region in which two-layer printing was performed by overlapping the white ink and the non-white ink and a region formed by using the white ink but not using the non-white ink, by using the treatment solution. In addition, it was possible to record an image in which both image quality (solid quality) in the white region and image quality (solid quality) in the non-white region were excellent. Further, it was also understood that the example in which it was possible to record an image in which color density or the shielding property in the white region was excellent, abrasion resistance was excellent, and stickiness resistance was excellent.

On the contrary, in Comparative Examples 1, 3, and 5 in which the above conditions were not satisfied, poor image quality in the first region was understood. In Comparative Examples 2 and 4 which did not use the treatment solution, poor image quality in the first region and the second region was understood.

In detail, it was understood that image quality in the example in which the maximum adhesion amount was smaller was particularly excellent, from the comparison between Examples 1 and 2. From the comparison between Example 1, and Examples 3 and 4, it was understood that image quality of an image to be recorded later in the example in which the time interval was in a predetermined range was particularly excellent.

From the comparison between Example 1 and Example 7, it was understood that image quality in the example in which the treatment solution was adhered before the ink for the first layer was particularly excellent. It was understood that, in a case where the treatment solution was adhered simultaneously, this case was advantageous from a point of improving the recording speed, and the above effects were sufficiently obtained. From the comparison between Example 2 and Example 28, it was understood that image quality tended to be deteriorated, but clogging resistance was excellent in the example in which the primary dry temperature was lower. Even in a case where the primary dry temperature was relatively low, it was understood that the invention was particularly useful in that sufficient image quality could be secured while obtaining excellent clogging resistance.

From the comparison between Example 2 and Example 29, it was understood that image quality was excellent, but abrasion resistance or stickiness resistance in the non-white region tended to be particularly poor in the example in which the adhesion amount ratio was higher was particularly excellent. It is supposed that an adhesive force between inks may be poor or decrease in abrasion resistance may be easily visually recognized because two kinds of the inks are stacked in the non-white region. From the above results, it was understood that a method of reducing the adhesion amount of the ink was more advantageous than a method of increasing the adhesion amount of the treatment solution, in order to improve image quality of the non-white region.

From Example 27, in a case where the ink adhesion amount of the white region was relatively small, color density or the shielding property of the white region was poor. Since the white region needed to secure the color density or the shielding property by using the white ink, it was determined that a case where the white ink adhesion amount of the white region was large was preferable. From Examples 13 to 24 and 26, it was understood that it was possible to obtain excellent image quality even in a case of satisfying Condition (i) or Condition (ii).

The invention is not limited to the above-described embodiment, and various modifications may be made. For example, the invention includes the substantially same configuration (for example, configuration in which the method and the result are the same, or configuration in which the object and the effects are the same) as the configuration described in the embodiment. The invention includes a configuration in which a not-fundamental part of the configuration described in the embodiment is replaced. The invention includes a configuration which shows the same advantageous effects as those of the configuration described in the embodiment or a configuration which is capable of achieving the same object as that of the configuration described in the embodiment. The invention includes a configuration in which the well-known technology is added to the configuration described in the embodiment.

The entire disclosure of Japanese Patent Application No. 2017-166751, filed Aug. 31, 2017 is expressly incorporated by reference herein.

What is claimed is:

1. A recording method comprising:

adhering a treatment solution for coagulating a component of an ink composition to a recording medium;

adhering a white ink composition including a white color material to the recording medium; and adhering a non-white ink composition including a non-white color material to the recording medium, wherein the adhering of the white ink composition and the adhering of the non-white ink composition are performed by performing scanning in which a relative position between an ink jet head and the recording medium is changed while the ink composition is discharged from the ink jet head, a first region in which the white ink composition and the non-white ink composition are adhered and a second region in which the white ink composition is adhered, and the non-white ink composition is not adhered are formed on the recording medium, and one or both of Condition (i) and Condition (ii) is satisfied:

(i) the first region and the second region are formed such that an adhesion amount of the white ink composition has a relationship of the first region<the second region; and (ii) the first region and the second region are formed such that the number of times of scanning in the adhering of the white ink composition has a relationship of the first region<the second region.

2. The recording method according to claim 1, wherein the adhesion amount of the white ink composition to the second region by one scanning in the adhering of the white ink composition is equal to or smaller than 4 mg/inch$^2$.

3. The recording method according to claim 1, wherein, in the first region, among the white ink composition and the non-white ink composition, a time from when adhering of one composition to be previously adhered at a predetermined position is completed until the other composition to be adhered later at the predetermined position is adhered is from 1 second to 60 seconds.

4. The recording method according to claim 1, wherein an adhesion amount of the treatment solution in the first region is from 5 mass % to 20 mass % of a total adhesion amount of the white ink composition and the non-white ink composition, and an adhesion amount of the treatment solution in the second region is from 5 mass % to 20 mass % of the adhesion amount of the white ink composition.

5. The recording method according to claim 1, wherein the adhering of the white ink composition and the adhering of the non-white ink composition are performed on the recording medium heated in first heating in which the recording medium is heated, and a surface temperature of the recording medium when the adhering of the white ink composition and the adhering of the non-white ink composition are performed is from 30° C. to 45° C.

6. The recording method according to claim 1, wherein, in the first region and the second region, the adhering of the treatment solution is performed before the adhering of the white ink composition and the adhering of the non-white ink composition.

7. The recording method according to claim 1, wherein, in the first region on a recording surface of the recording medium, either the white ink composition or the non-white ink composition is adhered on a side close to the recording medium.

8. The recording method according to claim 1, wherein recording is performed on a low-absorbent recording medium or a non-absorbent recording medium.

9. The recording method according to claim 1, wherein recording is performed by first scanning in which the white ink composition is adhered to the second region and the first region and second scanning in which the white ink composition is adhered to the second region, and the white ink composition is not adhered to the first region, the first scanning and the second scanning satisfying Condition (ii).

10. The recording method according to claim 1, wherein the treatment solution contains any one selected from a polyvalent metal salt, a cationic resin, and an organic acid, as a coagulant.

* * * * *